US006127110A

United States Patent [19]

Uchida

[11] Patent Number: 6,127,110

[45] Date of Patent: Oct. 3, 2000

[54] SILVER HALIDE EMULSION AND PHOTOGRAPHIC LIGHT-SENSITIVE MATERIAL USING THE SAME

[75] Inventor: Mitsuhiro Uchida, Minami-Ashigara, Japan

[73] Assignee: Fuji Photo Film Co., Ltd., Kanagawa, Japan

[21] Appl. No.: 09/200,792

[22] Filed: Nov. 30, 1998

Related U.S. Application Data

[62] Division of application No. 08/772,846, Dec. 24, 1996, Pat. No. 5,879,868.

[30] Foreign Application Priority Data

Jan. 8, 1996 [JP] Japan ..... 8-01013

[51] Int. Cl.[7] ..... G03C 1/035; G03C 1/08; G03C 1/34

[52] U.S. Cl. ..... 430/567; 430/569; 430/599; 430/607

[58] Field of Search ..... 430/567, 569, 430/599, 607

[56] References Cited

U.S. PATENT DOCUMENTS

| | | | |
|---|---|---|---|
| Re. 35,003 | 7/1995 | Takada | 430/567 |
| 5,418,124 | 5/1995 | Suga et al. | 430/567 |
| 5,556,741 | 9/1996 | Suga et al. | 430/569 |
| 5,616,453 | 4/1997 | Sekiya et al. | 430/504 |
| 5,804,364 | 9/1998 | Takehara | 430/569 |
| 5,879,868 | 3/1999 | Uchida | 430/506 |

*Primary Examiner*—Mark F. Huff
*Attorney, Agent, or Firm*—Birch, Stewart, Kolasch & Birch, LLP

[57] ABSTRACT

A silver halide emulsion in which in silver halide tabular grains having dislocation lines in a peripheral portion of a grain, no reduction sensitization is essentially performed before introduction of dislocation lines is started and reduction sensitization is performed after introduction of dislocation lines is started and before grain formation is completed, or a silver halide emulsion in which grain formation is performed in a silver nucleus stabilizing ambience and reduction sensitization is performed in the silver nucleus stabilizing ambience, and a silver halide photographic light-sensitive material using this emulsion.

8 Claims, No Drawings

SILVER HALIDE EMULSION AND PHOTOGRAPHIC LIGHT-SENSITIVE MATERIAL USING THE SAME

This application is a divisional of application Ser. No. 08/772,846, filed on 08/772,846, filed on Dec. 24, 1996, now U.S. Pat. No. 5,879,868, the entire contents of which are hereby incorporated by reference.

BACKGROUND OF THE INVENTION

The present invention relates to a high-speed silver halide emulsion having a high storage stability before and after exposure and a high resistance to damage by pressure, and a silver halide photographic light-sensitive material using the emulsion.

The basic performance required of a silver halide emulsion for a photographic light-sensitive material is to have a high sensitivity, a low fog, and fine grains.

To raise the sensitivity of an emulsion, it is necessary to (1) increase the number of photons absorbed by one grain, (2) raise the efficiency by which photoelectrons generated by light absorption are converted into silver clusters (latent image), and (3) raise the development activity in order to effectively use the generated latent image. As one countermeasure, increasing the size of a grain increases the number of photons absorbed by one grain, but this degrades the graininess. Also, the number of absorbed photons in a color sensitization region can be increased by increasing the amount of a spectral sensitizing dye which is used. However, the sensitivity decreases due to desensitization caused by the use of a large amount of a dye. In addition, although raising the development activity is an effective means for raising the sensitivity, this generally degrades the graininess in parallel type development such as color development. To increase the sensitivity without degrading the graininess, it is most preferable to raise the efficiency by which photoelectrons are converted into a latent image, i.e., raise the quantum sensitivity. To raise the quantum sensitivity, it is necessary to minimize an inefficiency factor, such as recombination or latent image dispersion, when photoelectrons are converted into a latent image. As one means, a method of reduction sensitization in which a small silver nucleus having no development activity is formed in the interior or on the surface of a silver halide grain is known to be effective to prevent recombination.

James et al. have found that when a coating film of an emulsion subjected to gold-sulfur sensitization is vacuum-deaerated and reduction-sensitized by heat-treating the film in a hydrogen gas ambience, sensitization can be performed at a lower fog level than in common reduction sensitization (T. A. Badcock, P. M. Ferguson, W. C. Lewis and T. H. James, Photogr. Sci. Eng., vol. 19 (1), 49 (1975)). This sensitization method is well known as hydrogen sensitization and is effective as a laboratory-scale sensitizing means. Hydrogen sensitization is actually used especially in the field of astronomical photographic light-sensitive materials.

Attempts of reduction sensitization have been studied for a long time. Carroll, Lowe et al., and Fallens et al., have disclosed in U.S. Pat. No. 2,487,850, U.S. Pat. No. 2,512,925, and British Patent 789,823 that a tin compound, a polyamine compound, and a thiourea dioxide compound are useful as reduction sensitizers, respectively. In addition, Collier compared the properties of silver nuclei formed by various reduction sensitization methods in "Photographic Science and Engineering", Vol. 23, page 113 (1979). She used methods using, e.g., dimethylaminoborane, stannous chloride, hydrazine, high-pH ripening, and low-pAg ripening. Methods of reduction sensitization are also disclosed in U.S. Pat. Nos. 2,518,698, 3,201,254, 3,411,917, 3,779,777, and 3,930,867. JP-B-57-33572 ("JP-B" means Published Examined Japanese Patent Application) and JP-B-58-1410 and JP-A-57-179835 ("JP-A" means Published Unexamined Japanese Patent Application) have disclosed not only selection of reduction sensitizers but also methods of using reducing agents. Furthermore, techniques of improving the storage stability of a reduction-sensitized emulsion are disclosed in JP-A-57-82831 and JP-A-60-178445.

Also, as described in T. H. James, "The Theory of the Photographic Process", 4th ed., Macmillan, 1977, page 152, a mechanism in which a silver nucleus consisting of two atoms formed by reduction sensitization captures a hole and decomposes into a silver ion and an unstable silver atom, the thermally unstable silver atom decomposes into a silver ion and a conductor electron, and this electron contributes to latent image formation is considered as reduction sensitization. This mechanism can increase the sensitivity to a maximum of a double sensitivity.

Unfortunately, reduction-sensitized emulsions have various drawbacks that, e.g., the storage fog is unsatisfactory, the exposed latent image undergoes intensification, and the sensitivity decreases when a raw sample is applied with a pressure, and so improvements have been demanded. It is considered that all these drawbacks result from the decomposition of unstable silver nuclei generated by reduction sensitization. Accordingly, studies have been made to remove unstable silver nuclei near the surface of a grain. JP-B-58-1410 has disclosed a method by which an oxidizing agent is added after the addition of a reducing agent. This method has attempted to remove unnecessary silver nuclei near the surface of a grain by chemically oxidizing the nuclei after reduction sensitization is performed. Also, JP-A-2-222939 has disclosed a method of removing unnecessary silver nuclei by adding thiosulfonic acid.

Although the above drawbacks are more or less improved by these techniques, the improvements are still on an unsatisfactory level. Therefore, further improvements have been demanded.

On the other hand, JP-A-63-220238 and JP-A-1-201649 have disclosed tabular silver halide grains in which dislocation lines (a kind of linear lattice defects existing in crystal) are intentionally introduced. These publications describe that tabular grains in which dislocation lines are introduced have excellent photographic characteristics such as sensitivity and reciprocity compared to tabular grains having no dislocation lines, and that the sharpness and the graininess are improved when these tabular grains are used in a light-sensitive material.

Also, JP-A-5-341459 describes that a silver halide emulsion having a high sensitivity and an improved graininess, gradation, and fog can be obtained by tabular silver halide grains having 10 or more dislocation lines per grain in a peripheral portion of a grain.

As described above, tabular grains in which dislocation lines are introduced have favorable properties to improve the sensitivity and the image quality.

To further improve the sensitivity and the image quality, it is very preferable to perform reduction sensitization for tabular grains in which dislocation lines are thus introduced. Unfortunately, it cannot be said that the storage stability and the resistance to damage by pressure described previously of tabular grains of this sort are satisfactory, and so techniques of improving the grains have been demanded.

BRIEF SUMMARY OF THE INVENTION

As described above, it is an object of the present invention to provide, in a reduction-sensitized high-speed emulsion, a silver halide emulsion whose storage stability and resistance to damage by pressure are improved and a photographic light-sensitive material using the emulsion.

The object of the present invention could be achieved by the following means.

(1) A silver halide emulsion in which silver halide tabular grains having dislocation lines in a peripheral portion of a grain account for 100 to 60% of a projected area of all silver halide grains in the silver halide emulsion, wherein no reduction sensitization is essentially performed before introduction of dislocation lines is begun and reduction sensitization is performed after introduction of dislocation lines is started and before grain formation is completed.

(2) A silver halide emulsion which grain formation is performed in a silver nucleus stabilizing ambience from the beginning of the grain formation or the midst of the grain formation to the end of the grain formation, and which reduction sensitization is performed in the silver nucleus stabilizing ambience.

(3) The silver halide emulsion described in item (2) above, wherein the silver halide emulsion consists of silver halide tabular grains whose average aspect ratio is 2 to 40, and silver halide tabular grains having dislocation lines in a peripheral portion of a grain account for 100 to 60% of a projected area of all silver halide grains in the silver halide emulsion.

(4) The silver halide emulsion described in any of items (1) to (3) above, wherein a solubility of silver ions when the reduction sensitization is performed is $1.5\times10^{-6}$ mol/l or less.

(5) The silver halide emulsion described in any of items (2) to (4) above, wherein the silver nucleus stabilizing ambience is achieved by adding a radical scavenger.

(6) The silver halide emulsion described in any of items (2) to (4) above, wherein the silver nucleus stabilizing ambience is achieved by setting a pH between 7 and 10.

(7) A silver halide photographic light-sensitive material comprising a red light-sensitive emulsion layer, a green light-sensitive emulsion layer, and a blue light-sensitive emulsion layer on a support, wherein each of the light-sensitive layers has at least two emulsion layers different in sensitivity, and at least one highest-speed layer of the light-sensitive layers contains a silver halide emulsion described in any of items (1) to (6) above.

(8) A silver halide photographic light-sensitive material comprising a red light-sensitive emulsion layer, a green light-sensitive emulsion layer, and a blue light-sensitive emulsion layer on a support, wherein each of the light-sensitive layers has at least two emulsion layers different in sensitivity, and the highest-speed blue-sensitive emulsion layer of the light-sensitive layers contains a silver halide emulsion described in any of items (1) to (6) above.

DETAILED DESCRIPTION OF THE INVENTION

The present invention will be described in detail below.

Various studies are being made to raise the sensitivity of a silver halide emulsion, and steady progress is being made. However, demands on a high sensitivity, a high graininess, a high storage stability, and a high resistance to damage by pressure as a photographic light-sensitive material are increasing, and so the current improvements are far from a satisfactory level.

On the other hand, as described earlier, reduction sensitization has a potential of increasing the sensitivity to a maximum of a double sensitivity. Although many studies have been made to use reduction sensitization to raise the sensitivity, the storage stability and the resistance to damage by pressure are still on an unsatisfactory level. Therefore, further improvements are demanded.

It is considered that reduction sensitization performs sensitization in accordance with the following process by forming a silver nucleus in the interior of a silver halide grain and/or on the surface of a silver halide grain.

$$AgX+h\nu \rightarrow e^- + h^+ \quad (1)$$

$$Ag_2+h^+ \rightarrow Ag^+ + Ag \quad (2)$$

$$Ag \rightarrow Ag^+ + e^- \quad (3)$$

In the above reaction formulas, $e^-$ and $h^+$ represent a free electron and a free hole, respectively, generated by exposure, $h\nu$ represents a photon, and $Ag_2$ represents a reduced silver nucleus formed by reduction sensitization. Although the size of a silver nucleus is unknown, in these formulas a silver nucleus is described as a dimmer. That is, it is considered that the sensitivity is raised by reduction sensitization because a free hole generated by exposure of one photon reacts with a reduced silver nucleus to generate another free electron.

It is considered that reduced silver nuclei include several types of silver nuclei having different properties. A silver nucleus expressed by reaction formula (2) is called a hole-capturing silver nucleus since this nucleus has a hole-capturing property. An electron-capturing silver nucleus which captures potential is also known. The present inventors further estimate that there is a decomposable silver nucleus which readily decomposes during storage or when applied with a pressure. The present inventors consider that a silver nucleus having this property degrades the storage stability or the resistance to damage by pressure as the object of the present invention.

When a silver nucleus decomposes, the nucleus can release an electron without any exposure as indicated by the following reaction formula, and this produces fog.

$$\text{heat, pressure } Ag_2(\text{unstable silver nucleus}) \rightarrow Ag_2^+ + e^- \quad (4)$$

Accordingly, to improve the storage stability and the resistance to damage by pressure, it is only necessary to prevent the reaction of formula (4) from occurring. The most effective method is to prevent an unstable silver nucleus causing the reaction of formula (4) from being generated/to eliminate the unstable silver nucleus.

In conventional reduction sensitization methods, it is essentially impossible to perfectly control the type of silver nucleus formed by reduction sensitization. Therefore, attempts have been made to remove an unstable silver nucleus formed on the most unstable surface. Representative examples are methods of adding an oxidizing agent and thiosulfonate. However, these methods cannot completely remove unstable silver nuclei and, in some instances, further form unstable silver nuclei.

Accordingly, it is very difficult to remove unstable silver nuclei once formed, and so it is important to prevent the formation of unstable silver nuclei.

The present inventors have considered that unstable silver nuclei are formed when hole-capturing silver nuclei or electron-capturing silver nuclei once decompose and rearrange. That is, when reduction sensitization is performed during grain formation, a large number of silver nuclei are formed by reduction sensitizers. During grain growth some of these silver nuclei decompose, rearrange, and form unstable silver nuclei near the surface of a grain. When an oxidizing agent or thiosulfonic acid is added, the decomposition of silver nuclei is accelerated and this further increases unstable silver nuclei.

From the foregoing, it is understood that to prepare a reduction-sensitized silver halide emulsion having a high storage stability and a high resistance to damage by pressure, it is only necessary to perform reduction sensitization by which no unstable silver nuclei are formed, and to prevent the formation of unstable silver nuclei, it is only necessary to prevent decomposition of silver nuclei formed by reduction sensitization. That is, the object of the present invention is achieved by performing grain formation in a silver nucleus stabilizing ambience from the beginning of the grain formation or the midst of the grain formation to the end of the grain formation, and performing reduction sensitization in this silver nucleus stabilizing ambience.

The silver nucleus stabilizing ambience is an ambience which stabilizes silver nuclei formed by reduction sensitization as described above so that these nuclei do not decompose. More specifically, the silver nucleus stabilizing ambience can be determined by the following method.

Silver Nucleus Stabilizing Ambient Determination Method

Preparation of Emulsion for Evaluation 40 g of gelatin were dissolved in 1200 cc of water, and the solution was strongly stirred while being held at 76° C. 190 cc of an aqueous 0.2 N solution of silver nitrate were added over 5 min and 30 sec. Simultaneously, 0.2 mol/l of an aqueous KBr solution was added so that the pAg was controlled to 6.8.

Subsequently, an aqueous solution containing 220 g of silver nitrate was added at a rate at which no renucleation was caused. Simultaneously, an aqueous KBr solution was added so that the pAg was controlled to 8.0.

After the grain formation was thus performed, ripening was performed for 60 min by adding $1\times10^{-6}$ mol of thiourea dioxide per 1 mol of silver.

When the ripening was completed, sedimentation and washing were performed so that the salt density was 1/200, and redispersion was performed at 40° C. so that the pAg was 9.2. The resultant emulsion was an octahedral grain with an equivalent-sphere diameter of 0.3 fm and was found to contain 150 g of silver and 57 g of gelatin in 1 kg of the emulsion.

Determination of Silver Nucleus Stabilizing Ambience 200 g of the resultant emulsion were dissolved in 1000 cc of water, and the temperature, the pH, the pAg, and the addition of chemicals were prepared to obtain an ambience for determination. In this state, the solution was aged for 12 hours and a support was coated with the aged solution and a protective layer. The coated sample was so formed that the Ag coating amount was 1 g/m$^2$.

For comparison, a sample coated with a solution not aged for 12 hours was also formed.

These samples were left to stand at 40° C. and a relatively humidity of 70% for 14 hours, exposed through a continuous wedge for 10 sec, and developed with the following processing solution at 20° C. for 30 min.

| (Processing solution) | |
|---|---|
| Metol | 2 g |
| Hydroquinone | 8 g |
| Soda sulfite anhydride | 90 g |
| Soda carbonate anhydride | 45 g |
| KBr | 5 g |
| Water to make | 1 l |

After the processing, fixing and washing were performed and the densities were measured.

In accordance with the results of the density measurement, an exposure amount by which a density of 0.2 was given was calculated and the logarithm of the reciprocal of the calculated amount was taken as the sensitivity.

A silver nucleus stabilizing ambience was defined that the width of a variation between the sensitivity with 12-hour aging and the sensitivity without 12-hour aging was within ±0.1.

The following methods can be used to form a silver nucleus stabilizing ambience.

(1) A method of adding a radical scavenger.

(2) A method of setting a pH between 7 and 10.

(3) A method of setting a silver ion solubility to $1.5\times10^{-6}$ mol/l or less.

Each method will be described in detail later.

The object of the present invention can also be achieved by a silver halide emulsion in which silver halide tabular grains having dislocation lines in a peripheral portion of a grain account for 100 to 60% of a projected area of all silver halide grains in the silver halide emulsion, wherein no reduction sensitization is essentially performed before introduction of dislocation lines is begun and reduction sensitization is performed after introduction of dislocation lines is started and before grain formation is completed. In this specification, a tabular grain having dislocation lines in a peripheral portion of the grain is also called a fringe portion dislocation lines type tabular grain.

A dislocation line is more specifically a linear lattice defect at the boundary between a region which has already slipped and a region which has not slipped yet on a slip plane of crystal.

Dislocation lines in silver halide crystal are described in, e.g.,

1) C. R. Berry. J. Appl. Phys., 27, 636 (1956),

2) C. R. Berry, D. C. Skilman, J. Appl. Phys., 35, 2165 (1964),

3) J. F. Hamilton, Phot. Sci. Eng., 11, 57 (1967),

4) T. Shiozawa, J. Soc. Phot. Sci. Jpn., 34, 16 (1971), and

5) T. Shiozawa, J. Soc. Phot. Sci. Jpn., 35, 213 (1972).

Dislocation lines can be analyzed by an X-ray diffraction method or a direct observation method using a low-temperature transmission electron microscope.

In direct observation of dislocation lines using a transmission electron microscope, silver halide grains, extracted carefully from an emulsion so as not to apply a pressure at which dislocation lines are produced in the grains, are placed on a mesh designed for use in electron microscopic observation, and are cooled in order to prevent damages (e.g., print out) due to electron rays. Then the observation of the sample is performed by a transmission method.

In this method, as the thickness of a grain is increased, it becomes more difficult to transmit electron rays through it. Therefore, grains can be observed more clearly by using an electron microscope of a high voltage type (200 kV or more for a thickness of 0.25 μm).

In the case of tabular grains, the positions and the numbers of dislocation lines of individual grains viewed in a direction perpendicular to their major planes can be obtained from a photograph of the grains taken by using an electron microscope.

Note that dislocation lines can or cannot be seen depending on the angle of inclination of a sample with respect to electron rays. Therefore, in order to observe dislocation lines without omission, it is necessary to obtain the positions of dislocation lines by observing photographs of the same grain taken at as many sample inclination angles as possible.

In the present invention, it is preferable to take five photographs of the same grain at inclination angles different by a 5° step by using a high-voltage electron microscope, thereby obtaining the positions and the number of dislocation lines.

If dislocation lines are densely present or cross each other, it is sometimes impossible to accurately count the dislocation lines per grain. Even in this case, however, dislocation lines can be roughly counted to such an extent as in units of tens, such as 10, 20, and 30.

A "tabular grain having dislocation lines in a peripheral portion of the grain" mentioned in the present invention is a grain having at least one dislocation line in a peripheral portion of the grain. The grain is a high-density dislocation lines type grain having preferably 10 or more, more preferably 50 or more, and most preferably 100 or more dislocation lines in a peripheral portion or the grain.

It is preferable that these dislocation lines be essentially localized to a peripheral portion of a grain.

Silver halide emulsions of the present invention consist of tabular grains having dislocation lines only in a peripheral portion of silver halide.

A "peripheral portion of a grain" mentioned in the present invention is a portion outside a point at which, when viewed from the edge of a tabular grain, the silver iodide content becomes larger or smaller than the average silver iodide content of the whole grain in the distribution of silver iodide from the edge toward the center of the grain.

In the present invention, as described above, silver halide tabular grains having dislocation lines in a peripheral portion of a grain must occupy 100 to 60% (area) of all silver halide grains in a silver halide emulsion (an emulsion in each highest-speed layer) containing these tabular grains. The ratio is preferably 100 to 70%.

Reduction sensitization is not essentially performed for a fringe dislocation lines type tabular emulsion of the present invention before introduction of dislocation lines is started. "Reduction sensitization is not essentially performed" herein mentioned means that reduction sensitization conventionally known is not intentionally performed, and that no reduced silver nuclei contributing to sensitization exist.

Fringe dislocation lines type tabular emulsion of the present invention is characterized in that reduction sensitization is performed after introduction of dislocation lines is started and before grain formation is completed. According to the method of the present invention, it is possible to prepare a reduction-sensitized high-speed fringe dislocation lines tabular emulsion in which no unstable silver nuclei exist.

If reduced silver nuclei exist before introduction of dislocation lines is started, rearrangement of silver nuclei occur very easily due to the introduction of dislocation lines, and this forms a large number of unstable silver nuclei. Introduction of dislocation lines is done by the growth of lattice defects triggered by halogen gaps. It is considered that the introduction undergoes a vigorous rearrangement process of silver halide and it is estimated that decomposition of silver nuclei is also encouraged and this forms unstable silver nuclei. In contrast, when reduction sensitization is performed after introduction of dislocation lines is started, it is possible to form hole-capturing silver nuclei contributing to sensitization without forming any unstable silver nucleus.

A method of realizing a silver nucleus stabilizing ambience by adding a radical scavenger will be described below.

In the present invention, a radical scavenger is a compound which essentially decolorizes garbinoxyl (decreases the absorbance at 430 nm) when 0.05 mmol $dm^{-3}$ of an ethanol solution of garbinoxyl and 2.5 mmol $dm^{-3}$ of an ethanol solution of a test compound are mixed at 25° C. and a change of the absorbance at 430 nm with time is measured. (If the compound does not dissolve to the above concentration, the measurement can also be performed at a lower concentration.)

The decolorization rate constant of garbinoxyl obtained by the above method is preferably 0.01 $mmol^{-1}s^{-1}dm^3$ or more, and more preferably 0.1 $mmol^{-1}s^{-1}dm^3$ or more.

A method of obtaining a radical scavenge rate by using garbinoxyl is described in Microchemical Journal 31, 18–21 (1985). A stopped flow method is described in, e.g., Spectral Research Vol. 19, No. 6 (1970), page 321.

By the addition of the radical scavenger as described above, it is possible to trap radicals which destroy silver nuclei and realize a silver nucleus stabilizing ambience.

In the present invention, it is more preferable to use compounds represented by formulas (A-I) to (A-V) as the radical scavenger. Among these compounds, formula (A-I) or (A-II) is more preferable.

Formula (A-1)

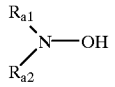

Formula (A-II)

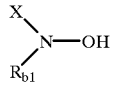

Formula (A-III)

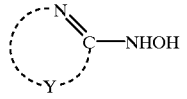

Formula (A-IV)

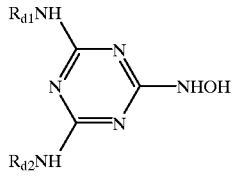

Formula (A-V)

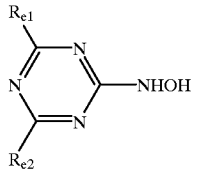

In formula (A-I), $R_{a1}$ represents an alkyl group, an alkenyl group, an aryl group, an acyl group, an alkylsulfonyl or arylsulfonyl group, an alkylsulfinyl or arylsulfinyl group, a carbamoyl group, a sulfamoyl group, an alkoxycarbonyl group, or an aryloxycarbonyl group, and $R_{a2}$ represents a hydrogen atom or a group represented by $R_{a1}$. If $R_{a1}$ is an alkyl group, an alkenyl group, or an aryl group, $R_{a2}$ is an acyl group, an alkylsulfonyl or arylsulfonyl group, an alkylsulfinyl or arylsulfinyl group, a carbamoyl group, a sulfamoyl group, an alkoxycarbonyl group, or an aryloxycarbonyl group. $R_{a1}$ and $R_{a2}$ may be bonded each other to form a 5- to 7-membered ring.

In formula (A-II), X represents a heterocyclic group, and $R_{b1}$ represents an alkyl group, an alkenyl group, or an aryl group. X and $R_{b1}$ may be bonded to each other to form a 5- to 7-membered ring.

In formula (A-III), Y represents nonmetallic atoms required to form a 5-membered ring together with —N═C—. Y further represents non-metal atom groups required to form a 6-membered ring together with the —N═C— group, and the end of Y which bonds to a carbon atom in the —N═C— group represents a group (which bonds to a carbon atom in —N═C— on the left side of the group) selected from —N($R_{c1}$)—, —(C($R_{c2}$), ($R_{c3}$)—, —C($R_{c4}$)═, —O—, and —S—. Each of $R_{c1}$ to $R_{c4}$ represents a hydrogen atom or a substituent group.

In formula (A-IV), $R_{d1}$ and $R_{d2}$ can be the same or different and each represents an alkyl group or an aryl group. If $R_{d1}$ and $R_{d2}$ are simultaneously nonsubstituted alkyl groups and $R_{d1}$ and $R_{d2}$ are identical groups, $R_{d1}$ and $Rd_{d2}$ are alkyl groups whose number of carbon atoms is 8 or more.

In formula (A-V), $R_{e1}$ and $R_{e2}$ can be the same or different and each represents a hydroxylamino group, a hydroxyl group, an amino group, an alkylamino group, an arylamino group, an alkoxy group, an aryloxy group, an alkylthio group, an arylthio group, an alkyl group, or an aryl group. Note that $R_{e1}$ and $R_{e2}$ cannot be —NH$R_{e3}$ ($R_{e3}$ is an alkyl group or an aryl group) at the same time.

$R_{a1}$ and $R_{a2}$ or X and $R_{b1}$ may be bonded to each other to form a 5- to 7-membered ring.

The present inventors have found that oxygen is one cause of variations in the photographic properties occurring while a light-sensitive material is stored or after photographing and before development.

The present inventors estimate that a certain compound in a light-sensitive material reacts with oxygen to have an influence on the photographic properties and compounds represented by formulas (A-I) to (A-V) above capture this compound.

Variations of the photographic properties are sometimes increased when a gelatin coating amount is increased. The present inventors estimate that this is so because a slight amount of an impurity in gelatin reacts with oxygen to have an influence on the photographic properties.

It is also found that the resistance to damage by pressure can be improved by compounds represented by formulas (A-I) to (A-V).

The present invention will be described in more detail below.

Compounds represented by formulas (A-I) to (A-V) will be described in more detail below. In formula (A-I), $R_{a1}$ represents an alkyl group (preferably an alkyl group having 1 to 36 carbon atoms, e.g., methyl, ethyl, i-propyl, cyclopropyl, butyl, isobutyl, cyclohexyl, t-octyl, decyl, dodecyl, hexadecyl, and benzyl), an alkenyl group (preferably an alkenyl group having 2 to 36 carbon atoms, e.g., allyl, 2-butenyl, isopropenyl, oleyl, and vinyl), an aryl group (preferably an aryl group having 6 to 40 carbon atoms, e.g., phenyl and naphthyl), an acyl group (preferably an acyl group having 2 to 36 carbon atoms, e.g., acetyl, benzoyl, pivaloyl, α-(2,4-di-tert-amylphenoxy)butyryl, myristoyl, stearoyl, naphthoyl, m-pentadecylbenzoyl, and isonicotinoyl), an alkylsulfonyl or arylsulfonyl group (preferably an alkylsulfonyl or arylsulfonyl group having 1 to 36 carbon atoms, e.g., methanesulfonyl, octanesulfonyl, benzenesulfonyl, and toluenesulfonyl), an alkylsulfinyl or arylsulfinyl group (preferably an alkylsulfinyl or arylsulfinyl group having 1 to 40 carbon atoms, e.g., methanesulfinyl and benzenesulfinyl), a carbamoyl group (also including an N-substituted carbamoyl group and preferably a carbamoyl group having 1 to 40 carbon atoms, e.g., N-ethylcarbamoyl, N-phenylcarbamoyl, N,N-dimethylcarbamoyl, and N-butyl-N-phenylcarbamoyl), a sulfamoyl group (also including an N-substituted sulfamoyl group and preferably a sulfamoyl group having 1 to 40 carbon atoms, e.g., N-methylsulfamoyl, N,N-diethylsulfamoyl, N-phenylsulfamoyl, N-cyclohexyl-N-phenylsulfamoyl, and N-ethyl-N-dodecylsulfamoyl), an alkoxycarbonyl group (preferably an alkoxycarbonyl group having 2 to 36 carbon atoms, e.g., methoxycarbonyl, cyclohexyloxycarbonyl, benzyloxycarbonyl, isoamyloxycarbonyl, and hexadecyloxycarbonyl), or an aryloxycarbonyl group (preferably an aryloxycarbonyl group having 7 to 40 carbon atoms, e.g., phenoxycarbonyl and naphthoxycarbonyl). $R_{a2}$ represents a hydrogen atom or a group represented by $R_{a1}$.

In formula (A-II), represents a heterocyclic group (a group which forms a 5- to 7-membered heterocyclic ring having at least one of a nitrogen atom, a sulfur atom, an oxygen atom, or a phosphor atom as a ring constituent atom and in which the bonding position (the position of a monovalent group) of the heterocyclic ring is preferably a carbon atom, e.g., 1,3,5-triazine-2-yl, 1,2,4-triazine-3-yl, pyridine-2-yl, pyradinyl, pyrimidinyl, purinyl, quinolyl, imidazolyl, 1,2,4-triazole-3-yl, benzimidazole-2-yl, thienyl, furyl, imidazolydinyl, pyrrolinyl, tetrahydrofuryl, morpholinyl, and phosphinoline-2-yl). $R_{b1}$ represents an alkyl group, an alkenyl group, or an aryl group having the same meaning as $R_{a1}$ in formula (A-I).

In formula (A-III), Y represents non-metal atom groups (e.g., the cyclic group formed is imidazolyl, benzimidazolyl, 1,3-thiazole-2-yl, 2-imidazoline-2-yl, purinyl, or 3H-indole-2-yl) required to form a 5-membered ring together with —N═C—. Y further represents nonmetallic atoms required to form a 6-membered ring together with the —N═C— group, and the end of Y which bonds to a carbon atom in the —N═C— group represents a group (which bonds to a carbon atom in —N═C— on the left side of the group) selected from —N($R_{c1}$)—, —C($R_{c2}$) ($R_{c3}$)—, —C($R_{c4}$)═, —O—, and —S—. $R_{c1}$ to $R_{c4}$ can be the same or different and each represents a hydrogen atom or a substituent group (e.g., an alkyl group, an alkenyl group, an aryl group, an alkoxy group, an aryloxy group, an alkylthio group, an arylthio group, an alkylamino group, an arylamino group, and a halogen atom). Examples of the 6-membered cyclic group formed by Y are quinolyl, isoquinolyl, phthaladinyl, quinoxalinyl, 1,3,5-triazine-5-yl, and 6H-1,2,5-thiadiazine-6-yl.

In formula (A-IV), each of $R_{d1}$ and $R_{d2}$ represents an alkyl group (preferably an alkyl group having 1 to 36 carbon atoms, e.g., methyl, ethyl, i-propyl, cyclopropyl, n-butyl, isobutyl, hexyl, cyclohexyl, t-octyl, decyl, dodecyl, hexadecyl, and benzyl) or an aryl group (preferably an aryl group having 6 to 40 carbon atoms, e.g., phenyl and naphthyl). If $R_{d1}$ and $R_{d2}$ are simultaneously nonsubstituted alkyl groups and $R_{d1}$ and $R_{d2}$ are identical groups, $R_{d1}$ and $R_{d2}$ are alkyl groups whose number of carbon atoms are 8 or more.

In formula (A-V), each of $R_{e1}$ and $R_{e2}$ represents a hydroxylamino group, a hydroxyl group, an amino group, an alkylamino group (preferably an alkylamino group having 1 to 50 carbon atoms, e.g., methylamino, ethylamino, diethylamino, methylethylamino, propylamino, dibutylamino, cyclohexylamino, t-octylamino, dodecylamino, hexadecylamino, benzylamino, and benzylbutylamino), an arylamino group (preferably an arylamino group having 6 to 50 carbon atoms, e.g., phenylamino, phenylmethylamino, diphenylamino, and naphthylamino), an alkoxy group (preferably an alkoxy group having 1 to 36 carbon atoms, e.g., methoxy, ethoxy, butoxy, t-butoxy, cyclohexyloxy, benzyloxy, octyloxy, tridecyloxy, and hexadecyloxy), an aryloxy group (preferably an aryloxy group having 6 to 40 carbon atoms, e.g., phenoxy and naphthoxy), an alkylthio group (preferably an alkylthio group having 1 to 36 carbon atoms, e.g., methylthio, ethylthio, i-propylthio, butylthio, cyclohexylthio, benzylthio, t-octylthio, and dodecylthio), an arylthio group (preferably an arylthio group having 6 to 40 carbon atoms, e.g., phenylthio and naphthylthio), an alkyl group (preferably an alkyl group having 1 to 36 carbon atoms, e.g., methyl, ethyl, propyl, butyl, cyclohexyl, i-amyl, sec-hexyl, t-octyl, dodecyl, and hexadecyl), or an aryl group (preferably an aryl group having 6 to 40 carbon atoms, e.g., phenyl and naphthyl). Note that $R_{e1}$ and $R_{e2}$ cannot be —NHR (R is an alkyl group or an aryl group) at the same time.

$R_{a1}$ and $R_{a2}$ or X and $R_{b1}$ may be bonded to each other to form a 5- to 7-membered ring. Examples are a succinimide ring, a phthalimide ring, a triazole ring, a urazol ring, a hydantoin ring, and a 2-oxo-4-oxazolidinone ring.

Each group in compounds represented by formulas (A-I) to (A-V) can be further substituted by a substituent group.

Examples of the substituent group are an alkyl group, an alkenyl group, an aryl group, a heterocyclic group, a hydroxy group, an alkoxy group, an aryloxy group, an alkylthio group, an arylthio group, an amino group, an acylamino group, a sulfonamide group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group, and a hydroxyamino group.

In formula (A-I), it is preferable that $R_{a2}$ be a hydrogen atom, an alkyl group, an alkenyl group, or an aryl group and $R_{a1}$ be an acyl group, a sulfonyl group, a sulfinyl group, a carbamoyl group, a sulfamoyl group, an alkoxycarbonyl group, or an aryloxycarbonyl group. Formula (A-I) is more preferably a compound in which $R_{a2}$ is an alkyl group or an alkenyl group and $R_{a1}$ is an acyl group, a sulfonyl group, a carbamoyl group, a sulfamoyl group, an alkoxycarbonyl group, or an aryloxycarbonyl group. It is most preferable that $R_{a2}$ be an alkyl group and $R_{a1}$ be an acyl group.

In formula (A-II), $R_{b1}$ is preferably an alkyl group or an alkenyl group, and more preferably an alkyl group. X is preferably represented by formula (A-II-1) below, more preferably 1,3,5-triazine-2-yl, and most preferably a compound represented by formula (A-II-2) below.

Formula (A-II-1)

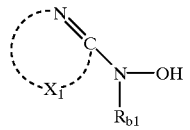

In formula (A-II-1), $R_{b1}$ represents $R_{b1}$ in formula (A-II), and $X_1$ represents non-metal atom groups required to form a 5- or 6-membered ring.

Of compounds represented by formula (A-II-1), a compound in which $X_1$ forms a 5- or 6-membered heterocyclic aromatic ring is more preferable.

Formula (A-II-2)

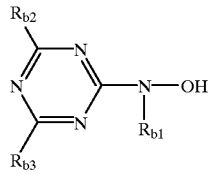

In formula (A-II-2), $R_{b1}$ represents $R_{b1}$ in formula (A-II). $R_{b2}$ and $R_{b3}$ can be the same or different and each represents a hydrogen atom or a substituent group.

Of compounds represented by formula (A-II-2), a compound in which each of $R_{b2}$ and $R_{b3}$ is a hydroxyamino group, a hydroxyl group, an amino group, an alkylamino group, an arylamino group, an alkoxy group, an aryloxy group, an alkylthio group, an arylthio group, an alkyl group, or an aryl group is particularly preferable.

Of compounds represented by formula (A-III), a compound in which Y represents non-metal atom groups required to form a 5-membered ring is preferable, and a compound in which the end atom of Y which bonds to a carbon atom of the —N═C— group is a nitrogen atom is more preferable.

A compound in which Y forms an imidazoline ring is most preferable. This imidazoline ring can also be condensed by a benzene ring.

Of compounds represented by formula (A-IV), a compound in which each of $R_{d1}$ and $R_{d2}$ is an alkyl group is preferable.

In formula (A-V), each of $R_{e1}$ and $R_{e2}$ is preferably a group selected from a hydroxyamino group, an alkylamino group, and an alkoxy group. It is particularly preferable that $R_{e1}$ be a hydroxylamino group and $R_2$ be an alkylamino group.

Of compounds represented by formulas (A-I) to (A-V), a compound whose total sum of carbon atoms is 15 or less is preferable to be made act on layers other than additive layer, and a compound whose total sum of carbon atoms is 16 or more is preferable to be made act only on additive layers.

Of compounds represented by formulas (A-I) to (A-V), compounds represented by formulas (A-I), (A-II), (A-IV), and (A-V) are preferable, compounds represented by formulas (A-I), (A-IV), and (A-V) are more preferable, and compounds represented by formulas (A-I) and (A-V) are most preferable.

Practical examples of compounds represented by formulas (A-I) to (A-V) are presented below, but the present invention is not limited by these example.

A-1
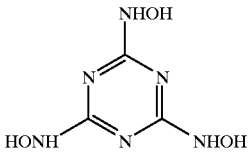
A-2
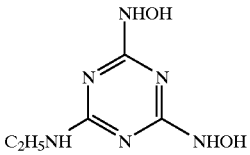
A-3
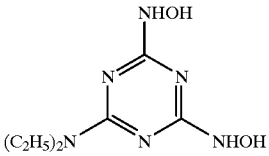
A-4
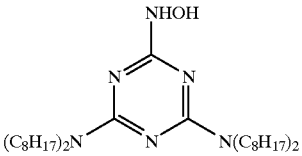
A-5
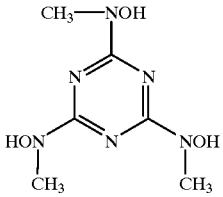
A-6
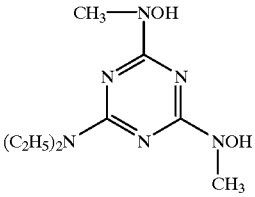
A-7
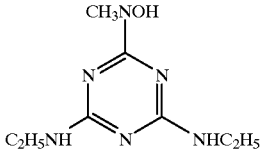
A-8
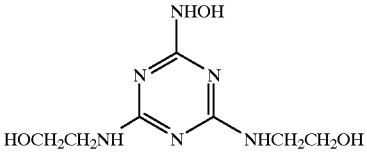
A-9
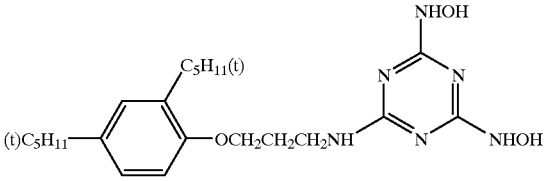
A-10
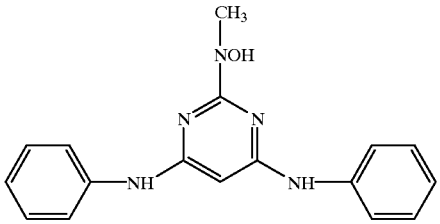
A-11
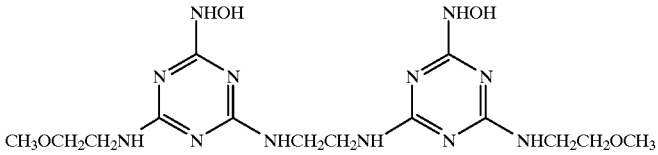
A-12
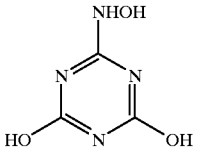
A-13
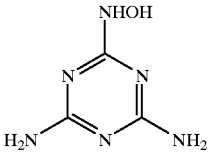

-continued
A-14
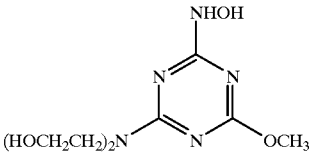
A-15
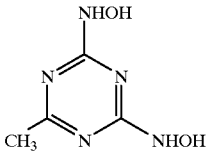
A-16
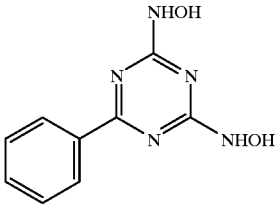
A-17
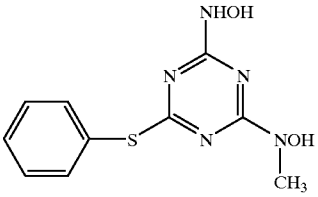
A-18
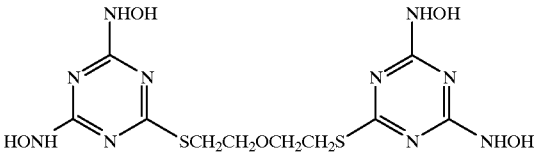
A-19
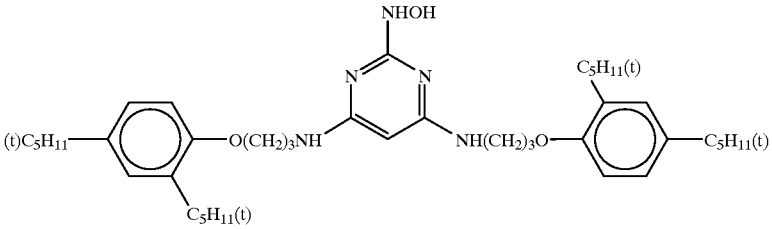
A-20
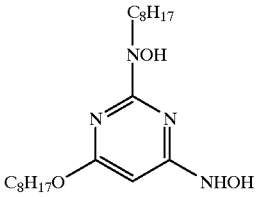
A-21
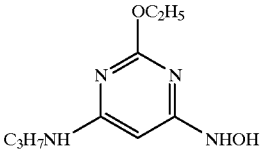
A-22
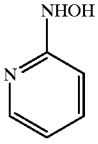
A-23
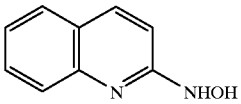
A-24
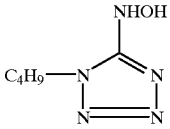
A-25
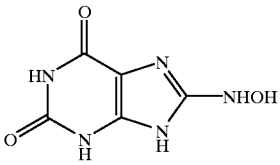
A-26
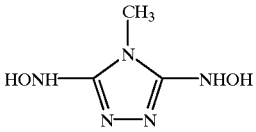
A-27
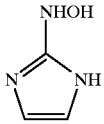

-continued
A-28
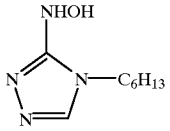
A-29
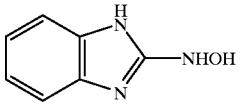
A-30
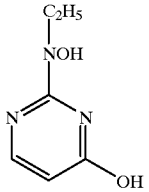
A-31
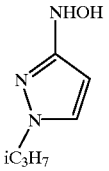
A-32
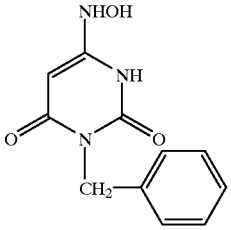
A-33
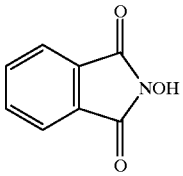
A-34
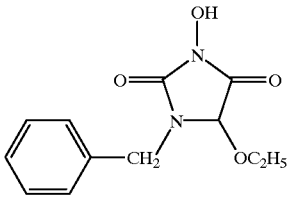
A-35
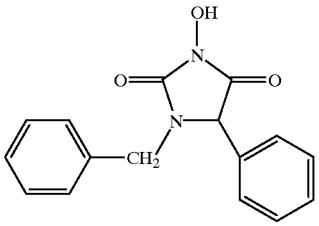
A-36
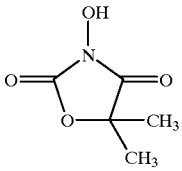
A-37
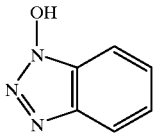
A-38
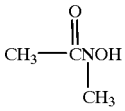
A-39
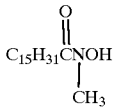
A-40
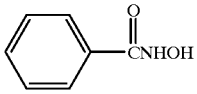
A-41
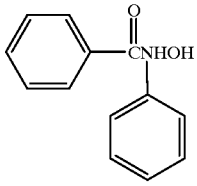
A-42
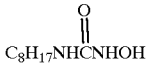
A-43
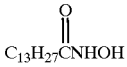

-continued

A-44

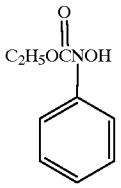

A-45

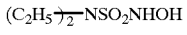

A-46

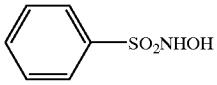

A-47

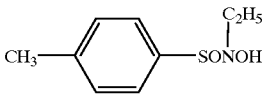

A-48

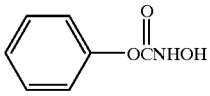

A-49

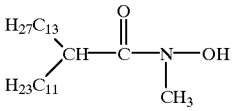

A-50

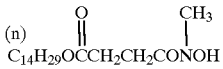

A-51

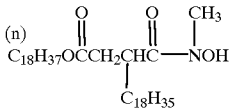

A-52

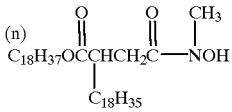

A-53

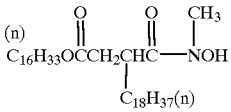

A-54

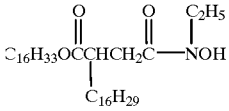

A-55

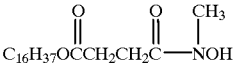

The correspondence between these compounds and formulas (A-I) to (A-V) is as follows.

Formula (A-I): A-33–A-55.

Formula (A-II): A-5–A-7, A-10, A-20.

Formula (A-III): A-21–A-32.

Formula (A-IV): A-8, A-11, A-19.

Formula (A-V): A-1–A-4, A-9, A-12–A-18.

These compounds of the present invention can be easily synthesized by methods described in, e.g., J. Org. Chem., 27, 4054('62), J. Amer. Chem. Soc., 73, 2981('51), and JP-B-49-10692, or by methods based on these methods.

In the present invention, compounds represented by formulas (A-I) to (A-V) can be added by dissolving them in any of water, a water-soluble solvent such as methanol or ethanol, and a solvent mixture of these solvents, or can be added by-emulsion dispersion.

If the solubility of a compound is increased by raising or lowering the pH when the compound is dissolved in water, the compound can be dissolved by raising or lowering the pH and added.

In the present invention, two or more different types of compounds represented by formulas (A-I) to (A-V) can be used together.

To form a silver nucleus stabilizing ambience, it is necessary to add an enough amount of a radical scavenger during grain formation. The amount is preferably $1\times10^{-4}$ to $5\times10^{-2}$ mole, and more preferably $5\times10^{-4}$ to $2\times10^{-3}$ mole per mole of silver.

Although the radical scavenger of the present invention can be added at any timing before the end of grain formation, the scavenger must be added before or simultaneously with the start of reduction sensitization. In the case of a fringe dislocation lines tabular emulsion, the radical scavenger is preferably added before introduction of dislocation lines.

A method of realizing a silver nucleus stabilizing ambience by using pH will be described below.

Ripening an emulsion in a high-pH environment is known as one method of reduction sensitization. It is considered that high-pH reduction sensitization is relatively weak reduction sensitization and forms a small amount of reduced silver nuclei compared to reduction sensitization performed by the addition of a reducing agent.

The present inventors have found that a high pH is an ambience which makes silver nuclei stabler than in a low pH. That is, a silver nucleus stabilizing ambience of the present invention can be achieved by setting the pH between 7 and 10. A high pH can simultaneously realize reduction sensitization and a silver nucleus stabilizing ambience, and in this case a more preferable pH range is 8 to 9. It is also possible to form a silver nucleus stabilizing ambience at a high pH and then perform reduction sensitization by adding a reducing agent. If this is the case, the reaction activity increases due to a high pH depending on the type of reduction sensitizer. Accordingly, desired reduction sensitization can be performed by the addition of a smaller amount of a reducing agent than when a reducing agent is added in a low-pH environment.

The solubility of silver ions when reduction sensitization of the present invention is performed is preferably $1.5\times10^{-6}$ mol/l or less, and more preferably $1.0\times10^{-6}$ mol/l or less.

The silver ion solubility can be set to a desired solubility by the temperature or the halogen concentration.

If the solubility of silver ions is high, silver nuclei readily rearrange to form unstable silver nuclei. Therefore, it is preferable for emulsions of the present invention that the silver ion solubility be as low as possible.

It is difficult to realize a silver nucleus stabilizing ambience of the present invention in the preparation of a silver halide emulsion performed by ripening using a conventionally known silver halide solvent.

In the present invention, it is preferable to use a silver halide emulsion prepared by a method in which no ripening using a silver halide solvent is performed. As an example, preparing a silver halide emulsion by using a previously prepared seed emulsion is one preferable method.

A reduction sensitization method for a silver halide emulsion of the present invention will be described below. In a silver halide emulsion of the present invention, it is preferable that the inside of a grain is not reduction-sensitized and the outside of a grain is reduction-sensitized. The "inside/outside" of a grain herein mentioned is a convenient expression and does not necessarily mean a core/shell emulsion. That is, this means that when a grain is viewed from the outside toward the interior, a reduction-sensitized region extends from the surface toward the inside of the grain and there is a portion not subjected to reduction sensitization before the center of the grain. In the case of a tabular grain having dislocation lines, it is preferable that the inside of the dislocation lines is not reduction-sensitized and the outside is reduction-sensitized. Although the ratio of the inside to the outside herein mentioned can be any ratio provided that the object of the present invention is achieved, the outside of a grain subjected to reduction sensitization is preferably as small as possible. The outside of a region of preferably 40 to 90%, and most preferably 55 to 80%, as a silver amount ratio, is reduction-sensitized.

Reduction sensitization of the present invention can be accomplished by performing reduction sensitization during growth of silver halide grains. To "perform reduction sensitization during growth" herein mentioned, reduction sensitization can be performed while silver halide grains are physically ripened or while water-soluble silver salt or water-soluble alkali halide is added.

The reduction sensitization can be selected from a method of adding reduction sensitizers to a silver halide emulsion, a method called silver ripening in which grains are grown or ripened in a low-pAg ambience at pAg 1 to 7, and a method called high-pH ripening in which grains are grown or ripened in a high-pH ambience at pH 7 to 10. It is also possible to perform two or more of these methods together.

The method of adding reduction sensitizers is preferable in that the level of reduction sensitization can be finely adjusted.

Known examples of the reduction sensitizer are stannous chloride, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Although an addition amount of the reduction sensitizers must be so selected as to meet the emulsion manufacturing conditions, a preferable amount is $10^{-7}$ to $10^{-2}$ mole per mole of silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a given timing during grain growth is more desirable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period with grain growth.

Although the grain size of silver halide grains of the present invention can be any size, the size is preferably 0.05 μm to 3.0 μm as an equivalent-sphere diameter. In particular, silver halide grains having an equivalent-sphere diameter of 0.5 μm to 2.0 μm are preferable because the effect is enhanced when the present invention is applied to these grains.

As the silver halide grains of the present invention, both tabular grains and regular crystal grains can be used. As the regular crystal silver halide grains, it is possible to use an octahedral grain, a cubic grain, and a tetradecahedral grain as the intermediate between them.

The silver halide grains used in the present invention are most preferably tabular silver halide grains whose average aspect ratio is 2 to 40.

A tabular silver halide grain (to be referred to as a "tabular grain" hereinafter) is a general term of grains having one twin plane or two or more parallel twin planes. When all ions at lattice points on two sides of a (111) face have a mirror image relationship, this (111) face is a twin plane. When this tabular grain is viewed from the above, its shape is a triangle, a hexagon, or a circular triangle or hexagon. The triangular, hexagonal, and circular grains have parallel triangular, hexagonal, and circular outer surfaces, respectively.

In the present invention, the average aspect ratio of tabular grains is the number-average value of values obtained by dividing grain diameters by thicknesses of tabular grains having a grain size of 0.1 μm or more.

The grain size is the diameter of a circle having the same area as the projected area of parallel outer surfaces of a grain. The projected area of a grain can be obtained by measuring the area on an electron microscope and correcting the photographing magnification. Measurement of the grain thickness can be easily performed as follows. A metal is obliquely vapor-deposited together with a latex sphere as a reference on a grain, and the length of the shadow is measured on an electron microscope. The grain thickness is calculated with reference to the length of the shadow of the latex sphere.

The average aspect ratio is obtained as the arithmetic mean of aspect ratios of at least 100 silver halide grains.

The average aspect ratio of tabular grains used in the present invention is 2 to 40, preferably 3 to less than 10, and more preferably 4 to less than 8.

The size and thickness of tabular grains can take arbitrary values as long as the average aspect ratio is 2 to 40. However, the grain size is preferably 0.3 to 5.0 μm, and more preferably 0.4 to 3.0 μm. The grain thickness is preferably 0.05 to 1.0 μm, and more preferably 0.05 to 0.3 μm.

It is sometimes possible to obtain more preferable effects by using monodisperse tabular grains. Although the structure and the method of manufacturing monodisperse tabular grains are described in, e.g., JP-A-63-151618, the shape of the grains will be briefly described below. That is, a hexagonal tabular silver halide, in which the ratio of an edge having the maximum length with respect to the length of an edge having the minimum length is 2 or less, and which has two parallel planes as outer surfaces, accounts for 70% or more of the total projected area of silver halide grains. In addition, these hexagonal tabular silver halide grains are monodisperse, i.e., the variation coefficient of the grain size distribution of the grains (a value obtained by dividing a variation (standard deviation) in grain sizes, which are represented by equivalent-circle diameters of projected areas of the grains, by their average grain size) is 25% or less. The variation coefficient is more preferably 20% or less.

Furthermore, the tabular grains used in the present invention preferably have dislocation lines as described earlier.

Photographic emulsions used in the present invention can be prepared by the methods described in, e.g., P. Glafkides, Chemie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and methods described in U.S. Pat. Nos. 4,334,012, 4,301,241, and 4,150,994. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852, and 4,142,900, European Patents 273,429, and 273,430, and West German Patent 3,819,241. This method is an effective grain formation method. To convert into a silver salt which can hardly be dissolved, it is possible to add a solution or silver halide grains of a soluble halogen. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757, and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885, and 2,555,364.

Although the use of a silver halide solvent is effective to accelerate ripening of silver halide grains, caution should be exercised when this is applied to emulsions of the present invention. As the most preferable method, it is known to make an excess amount of halogen ion exist in a reactor vessel. The use of another solvent is unpreferable because unstable silver nuclei are readily formed when reduction sensitization is performed. When ripening using a silver halide solvent is necessary, it is necessary to use a seed emulsion method or to remove the silver halide solvent in a washing step.

It is advantageous to use gelatin as a protective colloid for use in preparation of emulsions of the present invention or as a binder for other hydrophilic colloid layers. However, another hydrophilic colloid can also be used in place of gelatin.

Examples of the protective colloid and the binder are protein, such as a gelatin derivative, a graft polymer of gelatin and another high polymer, albumin, and casein; a cellulose derivative such as hydroxyethylcellulose, carboxymethylcellulose, and cellulose sulfates; soda alginate; a sugar derivative, such as starch derivative; and a variety of synthetic hydrophilic high polymers, such as homopolymers or copolymers, e.g.,, polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash a silver halide emulsion of the present invention for a desalting purpose and disperse in a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

Silver halide grains of the present invention can be subjected to at least one of sulfur sensitization, selenium sensitization, gold sensitization, palladium sensitization, or noble metal sensitization at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain; a type in which it is embedded in a shallow position from the surface of a grain, and a type in which it is formed on the surface of a grain. In emulsions of the present invention, the location of a chemical sensitization speck can be selected in accordance with the intended use. It is, however, generally preferable to form at least one chemical sensitization speck near the surface.

One chemical sensitization which can be preferably performed in the present invention is chalcogenide sensitization, noble metal sensitization, or a combination of these. The sensitization can be performed by using an active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30 to 80° C., as described in Research Disclosure, Vol. 120, April, 1974, 12008; Research Disclosure, Vol. 34, June, 1975, 13452, U.S. Pat. Nos. 2,642,361, 3,297,446, 3,772, 031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the two is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by R2PdX6 or R2PdX4 wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

When sulfur sensitization is performed in the present invention, as sulfur sensitizers it is possible to use hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411, 914, and 3,554,757, JP-A-58-126526, and G. F. Duffin, Photographic Emulsion Chemistry, pages 138 to 143.

It is preferable to also perform gold sensitization for emulsions of the present invention. The amount of a gold sensitizer is preferably $1\times10^{-4}$ to $1\times10^{-7}$ mole per mole of silver halide, and more preferably $1\times10^{-5}$ to $5\times10^{-7}$ mole.

A preferable amount of a palladium compound is $1\times10^{-3}$ to $5\times10^{-7}$ mole per mole of silver halide. A preferable amount of a thiocyan compound or a selenocyan compound is $5\times10^{-2}$ to $1\times10^{-6}$ mole per mole of silver halide.

The amount of a sulfur sensitizer with respect to silver halide grains of the present invention is preferably $1\times10^{-4}$ to $1\times10^{-7}$ mole, and more preferably $1\times10^{-5}$ to $5\times10^{-7}$ mole per mole of silver halide.

Selenium sensitization is a preferable sensitizing method for emulsions of the present invention. Known unstable selenium compounds are used in the selenium sensitization. Specific examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Photographic emulsions used in the present invention can be made contain various compounds in order to prevent fog during the preparing process, storage, or photographic processing of a light-sensitive material, or to stabilize photographic properties. Usable compounds are those known as an antifoggant or a stabilizer, for example, thiazoles, such as benzothiazoles, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindene, such as triazaindenes, tetrazaindenes (particularly hydroxy-substituted (1,3,3*a*,7)tetrazaindenes), and pentazaindenes. For example, compounds described in U.S. Pat. Nos. 3,954,474, and 3,982,947 and JP-B-52-28660 can be used. One preferable compound is described in JP-A-63-212932. Antifoggants and stabilizers can be added at any of several different timings, such as before, during, and after grain formation, during washing, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling the crystal walls of grains, decreasing the grain size, decreasing the solubility of grains, controlling chemical sensitization, and controlling the arrangement of dyes.

Although the various additives described above can be used in the silver halide photographic light-sensitive material of the present invention, a variety of other additives can also be used in accordance with the intended use.

The details of these additives are described in Research Disclosures (RD) Item 17643 (December, 1978), Item 18716 (November, 1979), and Item 307105 (November, 1989), and these portions are summarized in the tables below.

| | Additives | RD17643 | RD18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right colunm |
| 4. | Brighteners | page 24 | page 648, right column |
| 5. | Antifoggants and stabilizers | pages 24–25 | page 649, right column |
| 6. | Light absorbent, filter dye, ultraviolet absorbents | pages 25–26 | page 649, right column to page 650, left column |
| 7. | Stain preventing agents | page 25, right column | page 650, left to right columns |
| 8. | Dye image stabilizer | page 25 | page 650, left column |
| 9. | Hardening agents | page 26 | page 651, left column |
| 10. | Binder | page 26 | page 651, left column |
| 11. | Plasticizers, lubricants | page 27 | page 650, right column |
| 12. | Coating aids, surface active agents | pages 26–27 | page 650, right column |
| 13. | Antistatic agents | page 27 | page 650, right column |

| | Additives | RD307105 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbent, filter dye, ultraviolet absorbents | page 1,003, left column to page 1,003, right column |

-continued

| | | |
|---|---|---|
| 7. | Stain preventing agents | page 1,002, right column |
| 8. | Dye image stabilizer | page 1,002, right column |
| 9. | Hardening agents | page 1,004, right column to page 1,005, right column |
| 10. | Binder | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |

Other techniques and inorganic and organic materials usable in the color photographic light-sensitive material of the present invention are described in the portions of EP 436,938A2 and the patents cited below.

| | | |
|---|---|---|
| 1. | Layer arrangements | :page 146, line 34 to page 147, line 25 |
| 2. | Yellow couplers | :page 137, line 35 to page 146, line 33, and page 149, lines 21 to 23 |
| 3. | Magenta couplers | :page 149, lines 24 to 28; EP 421,453A1, page 3, line 5 to page 25, line 55 |
| 4. | Cyan couplers | :page 149, lines 29 to 33; EP 432,804A2, page 3, line 28 to page 40, line 2 |
| 5. | Polymer couplers | :page 149, lines 34 to 38; EP 435,334A2, page 113, line 39 to page 123, line 37 |
| 6. | Colored couplers | :page 53, line 42 to page 137, line 34, and page 149, lines 39 to 45 |
| 7. | Other functional couplers | :page 7, line 1 to page 53, line 41, and page 149, line 46 to page 150, line 3; EP 435,334A2, page 3, line 1 to page 29, line 50 |
| 8. | Antiseptic and mildewproofing agents | :page 150, lines 25 to 28 |
| 9. | Formalin scavengers | :page 149, lines 15 to 17 |
| 10. | Other additives | :page 153, lines 38 to 47; EP 421,453A1, page 75, line 21 to page 84, line 56, and page 27, line 40 to page 37, line 40 |
| 11. | Dispersion methods | :page 150, lines 4 to 24 |
| 12. | Supports | :page 150, lines 32 to 34 |
| 13. | Thickness and physical properties of film | :page 150, lines 35 to 49 |
| 14. | Color development process | :page 150, line 50 to page 151, line 47 |
| 15. | Desilvering process | :page 151, line 48 to page 152, line 53 |
| 16. | Automatic developing machine | :page 152, line 54 to page 153, line 2 |
| 17. | Washing/stabilizing | :page 153, lines 3 to 37 |

The present invention will be described in more detail below by way of its examples, but the invention is not limited to these examples.

EXAMPLES

Example 1

Emulsion 1A

Nucleation

While an aqueous solution prepared by dissolving 6 g of potassium bromide and 30 g of inert gelatin with an average molecular weight of 15,000 in 3.7 l of distilled water was well stirred, a 14% aqueous solution of potassium bromide and a 20% aqueous solution of silver nitrate were added to the solution by a double-jet method at fixed flow rates over 1 min at 55° C. and a pBr of 1.0 (in this addition 2.4% of the total silver amount were consumed).

Stop of Ripening

An aqueous gelatin solution (17%, 300 cc) was added, and the resultant solution was stirred at 55° C. After the pH was adjusted to 5.0, a 20% aqueous solution of silver nitrate was added at a fixed flow rate until the pBr reached 1.4 (in this addition 5.0% of the total silver amount were consumed).

First Growth

In addition, a 20% aqueous solution of potassium bromide ($KBr_{1-x}I_x$: x=0.08) and a 33% aqueous solution of silver nitrate were added by a double-jet method over 43 min (in this addition 50% of the total silver amount were consumed).

Introduction of Dislocation Lines and Final Growth

After an aqueous solution containing 8.3 g of potassium iodide was added, 14.5 ml of an aqueous solution of 0.001 wt. % $K_3IrCl_6$ were added, and a 20% potassium bromide solution and a 33% aqueous solution of silver nitrate were added by a double-jet method over 39 min (in this addition 42.6% of the total silver amount were consumed).

The amount of silver nitrate used in this emulsion was 425 g. The emulsion was then desalted by a conventional flocculation method, and the pAg and the pH were adjusted to 8.2 and 5.8, respectively, at 40° C. The prepared emulsion was a tabular silver iodobromide emulsion (emulsion 1A) having an average aspect ratio of 6.5, a variation coefficient of 18%, and an equivalent-sphere diameter of 0.8 $\mu$m. It was found by observation performed at a liquid $N_2$ temperature by using a 200 kV transmission electron microscope that, on the average, 50 or more dislocation lines were present per grain in a portion near the periphery of a tabular grain.

Emulsion 1B

An emulsion 1B was obtained following the same procedure as for the emulsion 1A, except that $1.2\times10^{-5}$ mol of thiourea dioxide was added per 1 mol of silver before the first growth was started. The emulsion 1B was reduction-sensitized before and after dislocation lines were introduced.

Emulsion 1C

An emulsion 1C was obtained following the same procedure as for the emulsion 1A, except that $1.2\times10^{-5}$ mol of thiourea dioxide was added per 1 mol of silver before the first growth was started and $2\times10^{-5}$ mol of benzenethiosulfonic acid was added per 1 mol of silver after the first growth was completed. The emulsion 1C was reduction-sensitized only before dislocation lines were introduced.

Emulsion 1D

An emulsion 1D was obtained following the same procedure as for the emulsion 1A, except that $1.2\times10^{-5}$ mol of thiourea dioxide was added per 1 mol of silver before the first growth was started and the pH was adjusted to 4.0 after the first growth was completed. The emulsion 1D was reduction-sensitized only before dislocation lines were introduced, and silver nuclei were grown in an unstable environment after dislocation lines were introduced.

Emulsion 1E

An emulsion 1E was obtained following the same procedure as for the emulsion 1A, except that $1.5\times10^{-5}$ mol of thiourea dioxide per 1 mol of silver was added 10 minutes after the final growth was started. The emulsion 1E was reduction-sensitized only after dislocation lines were introduced, and silver nuclei did not cause rearrangement due to the dislocation line introduction process.

Emulsion 1F

An emulsion 1F was obtained following the same procedure as for the emulsion 1A, except that the pH was adjusted to 9.0 before potassium iodide for introducing dislocation lines was added and $0.25\times10^{-5}$ mol of thiourea dioxide per 1 mol of silver was added 10 minutes after the final growth was started. The emulsion 1F was reduction-sensitized only after dislocations were introduced, and the reduction sensitization was performed in a silver nucleus stabilizing ambient.

Emulsion 1G

An emulsion 1G was obtained following the same procedure as for the emulsion 1A, except that $5\times10^{-4}$ mol of a radical scavenger (A-33) was added with respect to silver before potassium iodide for introducing dislocation lines was added and $1.5\times10^{-5}$ mol of thiourea dioxide per 1 mol of silver was added 10 minutes after the final growth was started. The emulsion 1G was reduction-sensitized only after dislocation lines were introduced, and the reduction sensitization was performed in a silver nucleus stabilizing ambience.

These emulsions 1A to 1G thus prepared were added with $3\times10^{-4}$ mol/molAg of a sensitizing dye ExS-1 (to be described later) and $6.5\times10^{-4}$ mol/molAg of a sensitizing dye ExS-9 (to be described later) and respectively optimally subjected to gold—selenium—sulfur sensitization by using sodium thiosulfate, chloroauric acid, N,N-dimethylselenourea, and potassium thiocyanate.

Formation of Multilayer Coated Sample 1A

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant film was longitudinally oriented by 3.3 times at 140° C., laterally oriented by 3.3 times at 130° C., and thermally fixed at 250° C. for 6 sec. The result was a 92 μm thick PEN (polyethylenenaphthalate) film. Note that this PEN film was added with proper amounts of blue, magenta, and yellow dyes (I-1, I-4, I-6, I-24, I-26, I-27, and II-5 described in Journal of Technical Disclosure No. 94-6023) so that the yellow density, the magenta density, and the cyan density were 0.01, 0.08, and 0.09, respectively. The PEN film was wound around a stainless steel core 20 cm in diameter and given a thermal history of 113° C. and 30 hours, preparing a support with a high resistance to curling.

2) Coating of undercoat layers

The two surfaces of the support were subjected to corona discharge, UV discharge, and glow discharge and coated with an undercoat solution (10 cc/m$^2$, by using a bar coater) consisting of 0.1 g/m$^2$ of gelatin, 0.01 g/m$^2$ of sodium α-sulfo-di-2-ethylhexylsuccinate, 0.025 g/m$^2$ of salicylic acid, 0.002 g/m$^2$ of PQ-1, and 0.006 g/m$^2$ of PQ-2, forming undercoat layers on sides at a high temperature upon orientation. Drying was performed at 115° C. for 6 min (all rollers and conveyors in the drying zone were at 115° C.).

3) Coating of back layers

On one surface of the undercoated support, an antistatic layer, a magnetic recording layer, and a slip layer having the following compositions were coated as back layers.

3-1) Coating of antistatic layer 0.027 g/m$^2$ of a dispersion (secondary aggregation grain size=about 0.08 μm) of a fine-grain powder, having a specific resistance of 5Ω.cm, of a tin oxide-antimony oxide composite material with an average grain size of 0.005 μm was coated together with 0.03 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), 0.008 g/m$^2$ of PQ-3, and resorcin.

3-2) Coating of magnetic recording layer 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt. % of iron oxide by aluminum oxide silicon oxide) coated with 3-polyoxyethylene-propyloxytrimethoxysilane (polymerization degree 15, 15 wt. %) was coated by a bar coater together with 1.15 g/m$^2$ of diacetylcellulose (iron oxide was dispersed by an open kneader and a sand mill) by using 0.075 g/m$^2$ of PQ-4 as a hardener and acetone, methylethylketone, and cyclohexane as solvents, forming a 1.2 μm thick magnetic recording layer. 50 g/m$^2$ of $C_6H_{13}CH(OH)C_{10}H_{20}COOC_{40}H_{81}$ was added as a slip agent, 5 mg/m$^2$ of silica grains (1.0 μm) were added as a matting agent, and 15 mg/m$^2$ of aluminum oxide (0.20 to 1.0 μm, manufactured by Raynozzle Metal Co., —ERC-DBM) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 emu/g, $7.3\times10^4$ A/m, and 65%, respectively.

3-3) Adjustment of slip layer 25 mg/m$^2$ of hydroxyethylcellulose, 7.5 mg/m$^2$ of PQ-6, 1.5 mg/m$^2$ of PQ-7, 6 mg/m$^2$ of $C_6H_{13}CH(OH)C_{10}H_{20}COOC_{40}H_{81}$, and 1.5 mg/m$^2$ of polydimethylsiloxane (B-3) were coated. Note that this mixture was melted in xylene/propylenemonomethylether (1/1) at 105° C., dispersed in propylenemonomethylether (tenfold amount) maintend at ambient temperature, and formed into a dispersion (average grain size 0.01 μm) in acetone before being added. Drying was performed at 115° C. for 6 min (all rollers and conveyors in the drying zone were at 115° C.). The resultant slip layer was found to have excellent characteristics; that is, the coefficient of kinetic friction was 0.10 (5 mmφ stainless steel hard sphere, load 100 g, speed 6 cm/min), the coefficient of static friction was 0.09 (clip method), and the coefficient of kinetic friction between an emulsion surface (to be described later) and the slip layer was 0.18.

The chemical structures of PQ-1 to PQ-7 used in the above layers are presented below.

PQ-1

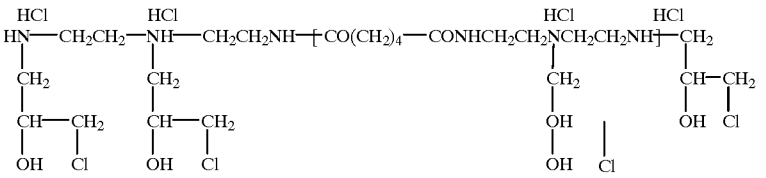

-continued

PQ-2

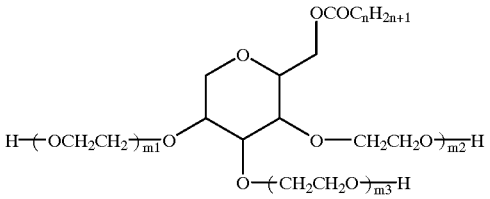

($p + Q + r \approx 20$)

PQ-3

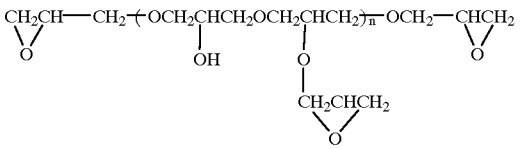

($n = 3$)

PQ-4

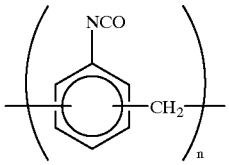

($n \approx 2$–$5$)

PQ-5

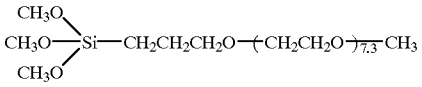

PQ-6

PQ-7

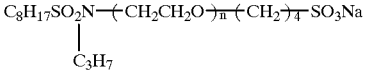

4) Coating of light-sensitive layers

On the side away from the back layers formed as above, a plurality of layers having the following compositions were coated to prepare a color negative film. The film is called a sample 101.

Compositions of Light-Sensitive Layers

The main materials used in the individual layers are classified as follows.

ExC: Cyan coupler

ExM: Magenta coupler

ExY: Yellow coupler

ExS: Sensitizing dye

UV: Ultraviolet absorbent

HBS: High-boiling organic solvent

H: Gelatin hardener

The number corresponding to each component indicates the coating amount in units of g/m$^2$. The coating amount of a silver halide is represented by the amount of silver. The coating amount of each sensitizing dye is represented in units of mols per mol of a silver halide in the same layer.

| (Sample 101) | | |
|---|---|---|
| 1st layer (1st antihalation layer) | | |
| Black colloidal silver | silver | 0.08 |

-continued

| (Sample 101) | | |
|---|---|---|
| Gelatin | | 0.70 |
| 2nd layer (2nd antihalation layer) | | |
| Black colloidal silver | silver | 0.90 |
| Gelatin | | 1.00 |
| ExM-1 | | 0.12 |
| ExF-1 | | $2.0 \times 10^{-3}$ |
| Solid dispersion dye ExF-2 | | 0.030 |
| Solid dispersion dye ExF-3 | | 0.040 |
| HBS-1 | | 0.15 |
| HBS-2 | | 0.02 |
| 3rd layer (Interlayer) | | |
| ExC-2 | | 0.05 |
| Polyethylacrylate latex | | 0.20 |
| Gelatin | | 0.70 |
| 4th layer (Low-speed red-sensitive emulsion layer) | | |
| Silver iodobromide emulsion A | silver | 0.20 |
| Silver iodobromide emulsion B | silver | 0.23 |
| silver iodobromide emulsion C | silver | 0.10 |
| ExS-1 | | $3.8 \times 10^{-4}$ |
| ExS-2 | | $1.6 \times 10^{-5}$ |
| ExS-3 | | $5.2 \times 10^{-4}$ |
| ExC-1 | | 0.17 |
| ExC-2 | | 0.02 |
| ExC-3 | | 0.030 |
| ExC-4 | | 0.10 |
| ExC-5 | | 0.020 |

-continued (Sample 101)

| | | |
|---|---|---|
| ExC-6 | | 0.010 |
| Cpd-2 | | 0.025 |
| HBS-1 | | 0.10 |
| Gelatin | | 1.10 |
| 5th layer (Medium-speed red-sensitive emulsion layer) | | |
| Silver iodobromide emulsion C | silver | 0.15 |
| Silver iodobromide emulsion D | silver | 0.46 |
| ExS-1 | | $4.0 \times 10^{-4}$ |
| ExS-2 | | $2.1 \times 10^{-5}$ |
| ExS-3 | | $5.7 \times 10^{-4}$ |
| ExC-1 | | 0.14 |
| ExC-2 | | 0.02 |
| ExC-3 | | 0.03 |
| ExC-4 | | 0.090 |
| ExC-5 | | 0.02 |
| ExC-6 | | 0.01 |
| Cpd-2 | | 0.05 |
| Cpd-4 | | 0.030 |
| HBS-1 | | 0.10 |
| Gelatin | | 0.75 |
| 6th layer (High-speed red-sensitive emulsion layer) | | |
| Silver iodobromide emulsion E | silver | 1.30 |
| ExS-1 | | $2.5 \times 10^{-4}$ |
| ExS-2 | | $1.1 \times 10^{-5}$ |
| ExS-3 | | $3.6 \times 10^{-4}$ |
| ExC-1 | | 0.12 |
| ExC-3 | | 0.11 |
| ExC-6 | | 0.020 |
| ExC-7 | | 0.010 |
| Cpd-2 | | 0.050 |
| Cpd-4 | | 0.020 |
| HBS-1 | | 0.22 |
| HBS-2 | | 0.050 |
| Gelatin | | 1.40 |
| 7th layer (Interlayer) | | |
| Cpd-1 | | 0.060 |
| Solid dispersion dye ExF-4 | | 0.030 |
| HBS-1 | | 0.040 |
| Polyethylacrylate latex | | 0.15 |
| Gelatin | | 1.10 |
| 8th layer (Low-speed green-sensitive emulsion layer) | | |
| Silver iodobromide emulsion F | silver | 0.22 |
| Silver iodobromide emulsion G | silver | 0.35 |
| ExS-4 | | $2.7 \times 10^{-5}$ |
| ExS-5 | | $7.0 \times 10^{-5}$ |
| ExS-6 | | $2.7 \times 10^{-4}$ |
| ExS-7 | | $6.2 \times 10^{-4}$ |
| ExS-8 | | $1.4 \times 10^{-4}$ |
| ExM-3 | | 0.41 |
| ExM-4 | | 0.086 |
| ExY-1 | | 0.070 |
| ExY-5 | | 0.0070 |
| HBS-1 | | 0.30 |
| HBS-3 | | 0.015 |
| Cpd-4 | | 0.010 |
| Gelatin | | 0.95 |
| 9th layer (Medium-speed green-sensitive emulsion layer) | | |
| Silver iodobromide emulsion G | silver | 0.48 |
| Silver iodobromide emulsion H | silver | 0.48 |
| ExS-4 | | $4.8 \times 10^{-5}$ |
| ExS-7 | | $9.3 \times 10^{-4}$ |
| ExS-8 | | $2.1 \times 10^{-4}$ |
| ExC-8 | | 0.0020 |
| ExM-3 | | 0.115 |
| ExM-4 | | 0.035 |
| ExY-1 | | 0.010 |
| ExY-4 | | 0.010 |
| ExY-5 | | 0.0050 |
| Cpd-4 | | 0.011 |
| HBS-1 | | 0.13 |
| HBS-3 | | $4.4 \times 10^{-3}$ |
| Gelatin | | 0.80 |

-continued (Sample 101)

| | | |
|---|---|---|
| 10th layer (High-speed green-sensitive emulsion layer) | | |
| Silver iodobromide emulsion I | silver | 1.30 |
| ExS-4 | | $4.5 \times 10^{-5}$ |
| ExS-7 | | $5.3 \times 10^{-4}$ |
| ExS-8 | | $1.2 \times 10^{4}$ |
| ExC-1 | | 0.021 |
| ExM-1 | | 0.010 |
| ExM-2 | | 0.030 |
| ExM-5 | | 0.0070 |
| ExM-6 | | 0.0050 |
| Cpd-3 | | 0.017 |
| Cpd-4 | | 0.040 |
| HBS-1 | | 0.25 |
| Polyethylacrylate latex | | 0.15 |
| Gelatin | | 1.33 |
| 11th layer (Yellow filter layer) | | |
| Yellow colloidal silver | silver | 0.015 |
| Cpd-1 | | 0.16 |
| Solid dispersion dye ExF-5 | | 0.060 |
| Solid dispersion dye ExF-6 | | 0.060 |
| Oil-soluble dye ExF-7 | | 0.010 |
| HBS-1 | | 0.60 |
| Gelatin | | 0.60 |
| 12th layer (Low-speed blue-sensitive emulsion layer) | | |
| Silver iodobromide emulsion J | silver | 0.09 |
| Silver iodobromide emulsion K | silver | 0.10 |
| Silver iodobromide emulsion L | silver | 0.25 |
| ExS-9 | | $8.4 \times 10^{-4}$ |
| ExC-1 | | 0.03 |
| ExC-8 | | $7.0 \times 10^{-3}$ |
| ExY-1 | | 0.050 |
| ExY-2 | | 0.75 |
| ExY-3 | | 0.40 |
| ExY-4 | | 0.040 |
| Cpd-2 | | 0.10 |
| Cpd-3 | | $4.0 \times 10^{-3}$ |
| Cpd-4 | | 0.10 |
| HBS-1 | | 0.28 |
| Gelatin | | 2.10 |
| 13th layer (High-speed blue-sensitive emulsion layer) | | |
| Emulsion 1A | silver | 0.58 |
| ExS-9 | | $3.5 \times 10^{-4}$ |
| ExY-2 | | 0.070 |
| ExY-3 | | 0.070 |
| ExY-4 | | 0.0050 |
| Cpd-2 | | 0.10 |
| Cpd-3 | | $1.0 \times 10^{-3}$ |
| Cpd-4 | | 0.02 |
| HBS-1 | | 0.070 |
| Gelatin | | 0.55 |
| 14th layer (1st protective layer) | | |
| Silver iodobromide emulsion M | silver | 0.10 |
| UV-1 | | 0.13 |
| UV-2 | | 0.010 |
| UV-3 | | 0.16 |
| UV-4 | | 0.025 |
| ExF8 | | 0.001 |
| ExF9 | | 0.002 |
| HBS-1 | | $5.0 \times 10^{-2}$ |
| HBS-4 | | $5.0 \times 10^{-2}$ |
| Gelatin | | 1.8 |
| 15th layer (2nd protective layer) | | |
| H-1 | | 0.40 |
| B-1 (diameter 1.7 μm) | | 0.06 |
| B-2 (diameter 1.7 μm) | | 0.09 |
| B-3 | | 0.13 |
| ES-1 | | 0.20 |
| Gelatin | | 0.70 |

In addition to the above components, to improve the storage stability, processability, resistance to damage by pressure, antiseptic and mildewproofing properties, antistatic properties, and coating properties, the individual layers contained W-1 to W-3, B-4 to B-6, F-1 to F-18, iron salt, lead salt, gold salt, platinum salt, palladium salt, iridium salt, and rhodium salt.

TABLE 1 below shows the average AgI contents and the grain sizes of the emulsions A to M used in the sample 101.

TABLE 1

| Emulsion | Average AgI content (%) | Average grain size represented by equivalent sphere diameter (μm) | Variation coefficient of grain size (%) | Projected area size represented by equivalent circle diameter (μm) | Diameter/ thickness ratio | Tabularability | Remarks |
|---|---|---|---|---|---|---|---|
| A | 3.7 | 0.37 | 13 | 0.43 | 2.3 | 12 | |
| B | 3.7 | 0.43 | 19 | 0.58 | 3.2 | 18 | |
| C | 5.0 | 0.55 | 20 | 0.86 | 6.2 | 45 | |
| D | 5.4 | 0.66 | 23 | 1.10 | 7.0 | 45 | |
| E | 4.7 | 0.85 | 22 | 1.36 | 5.5 | 22 | |
| F | 3.7 | 0.43 | 19 | 0.58 | 3.2 | 18 | |
| G | 5.4 | 0.55 | 20 | 0.86 | 6.2 | 45 | |
| H | 5.4 | 0.66 | 23 | 1.10 | 7.0 | 45 | |
| I | 7.5 | 0.85 | 24 | 1.30 | 5.0 | 19 | |
| J | 3.7 | 0.37 | 19 | 0.55 | 4.6 | 38 | |
| K | 3.7 | 0.37 | 19 | 0.55 | 4.6 | 38 | |
| L | 8.8 | 0.64 | 23 | 0.85 | 5.2 | 32 | |
| M | 1.0 | 0.06 | 15 | — | — | — | |

In TABLE 1, (1) The emulsions J to L were subjected to reduction sensitization during grain adjustment by using thiourea dioxide and thiosulfonic acid in accordance with the examples in JP-A-2-191938.

(2) The emulsions C to E and G to I were subjected to gold sensitization, sulfur sensitization, and selenium sensitization in the presence of the spectral sensitizing dyes described in the individual light-sensitive layers and sodium thiocyanate in accordance with the examples in JP-A-3-237450.

(3) The adjustment of tabular grains was performed by using low-molecular weight gelatin in accordance with the examples in JP-A-1-158426.

(4) Dislocation lines as described in JP-A-3-237450 were observed in tabular grains when a high-voltage electron microscope was used.

(5) The emulsions A to E, G, H, and J to L contained optimum amounts of Rh, Ir, and Fe.

Also, assuming that the average equivalent circle diameter of the projected areas of tabular grains is Dc and the average thickness of the tabular grains is t, the tabularability is represented by $$\text{tabularability}=Dc/t^2.$$

ExC-1

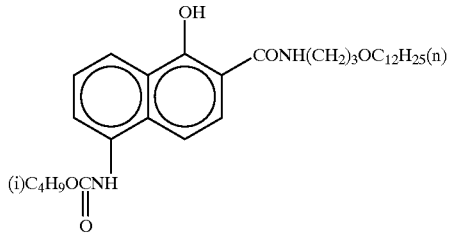

Adjustment of Dispersions of Organic Solid Dispersion Dyes

ExF-2 was dispersed by the following method. That is, 21.7 ml of water, 3 ml of a 5% aqueous solution of sodium p-octylphenoxyethoxyethanesulfonate, and 0.5 g of a 5% aqueous solution of p-octylphenoxypolyoxyethyleneether (polymerization degree 10) were placed in a 700-ml pot mill, and 5.0 g of the dye ExF-2 and 500 ml of zirconium oxide beads (diameter 1 mm) were added to the mill. The contents were dispersed for 2 hours. This dispersion was done by using a BO type oscillating ball mill manufactured by Chuo Koki K.K. The dispersion was removed from the mill and added to 8 g of a 12.5% aqueous solution of gelatin. The beads were removed from the resultant material by filtration, obtaining a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of EP 549,489A. The average grain size was found to be 0.06 μm.

The compounds used in the formation of the above layers are presented below.

-continued
ExC-2
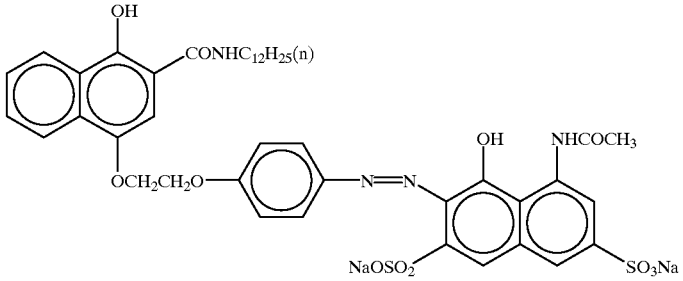
ExC-3
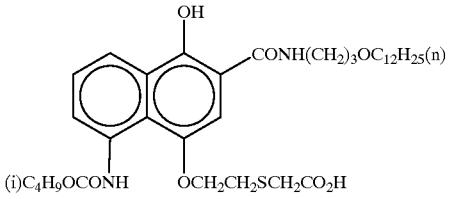
ExC-4
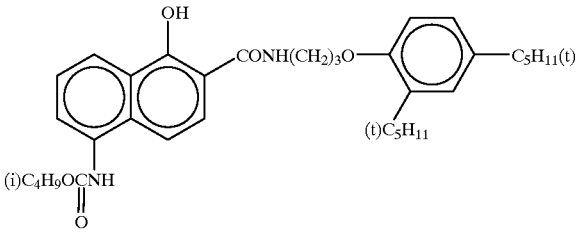
ExC-5
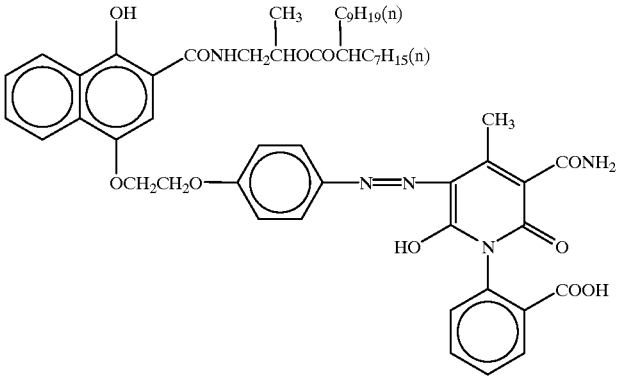
ExC-6
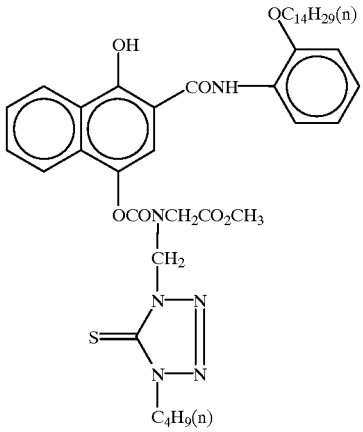
ExC-7
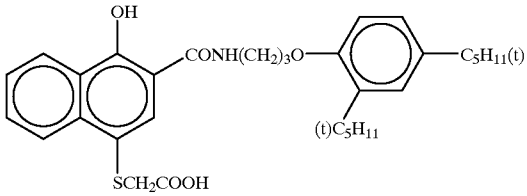

-continued
ExC-8
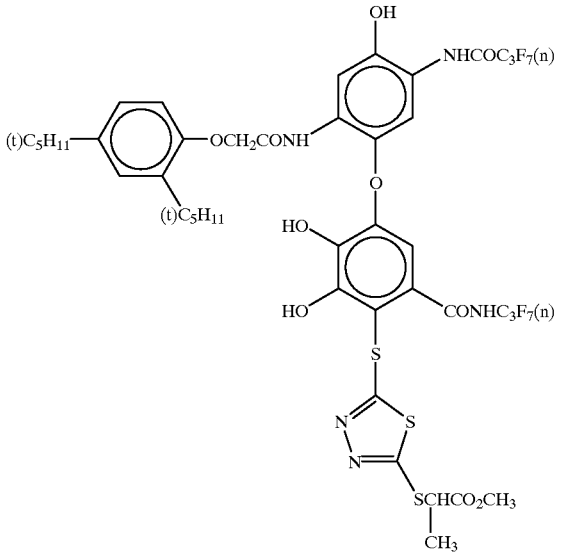
ExM-1
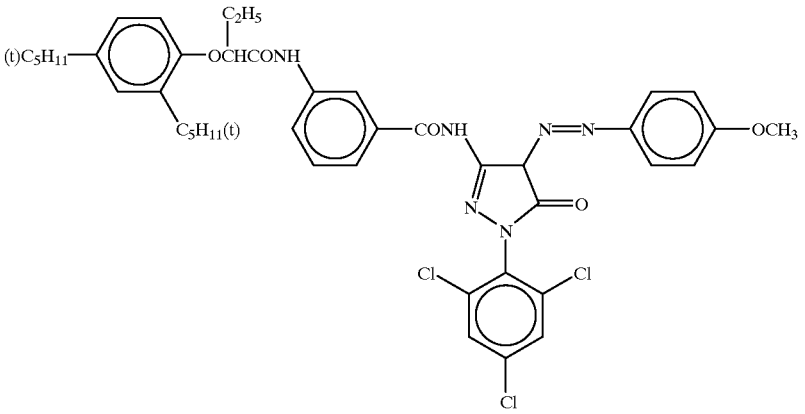
ExM-2
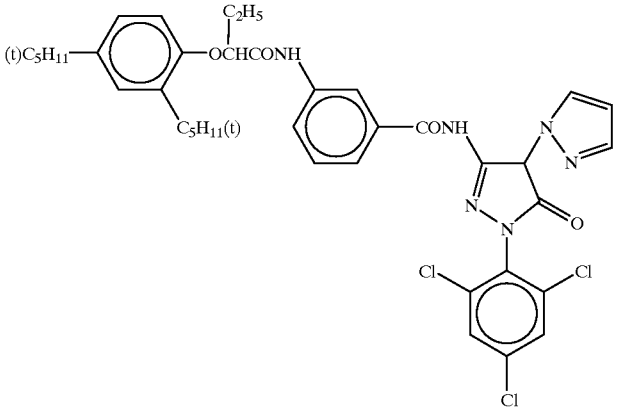

-continued
ExM-3
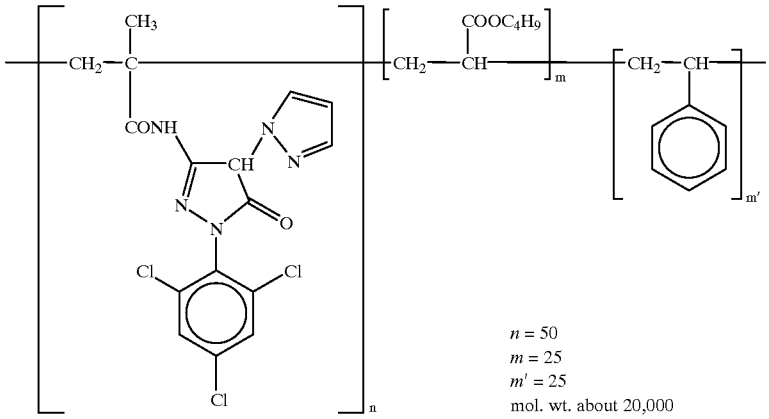
*n* = 50
*m* = 25
*m'* = 25
mol. wt. about 20,000
ExM-4
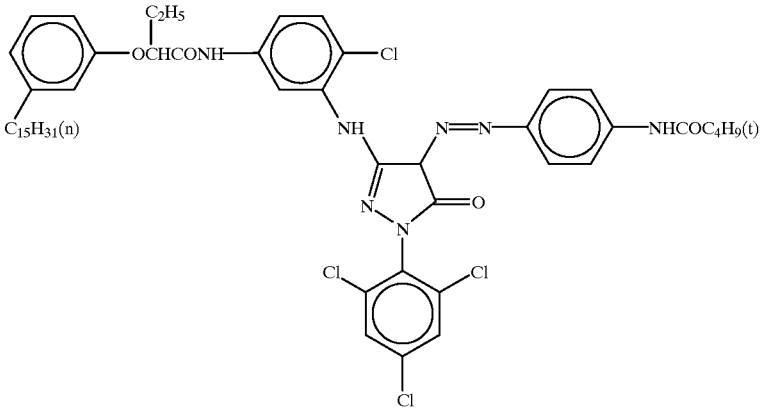
ExM-5
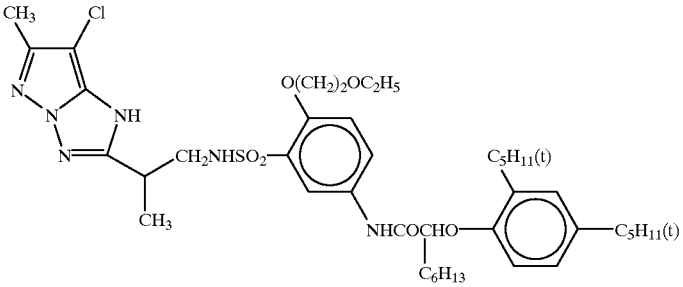
ExM-6
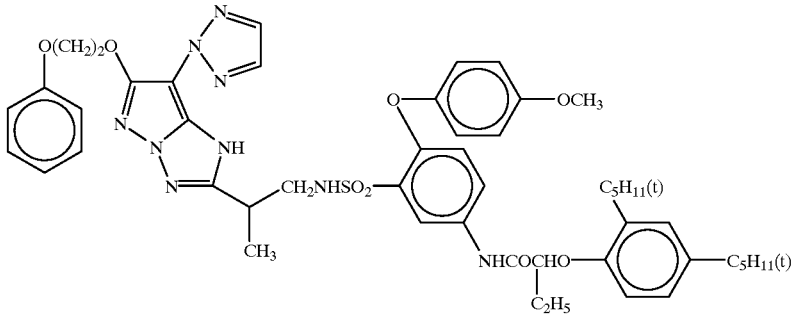

-continued
ExY-1
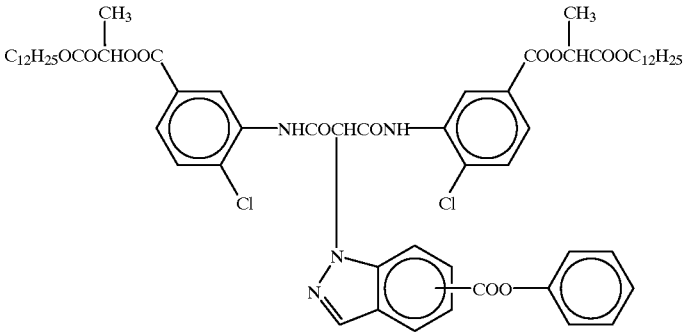
ExY-2
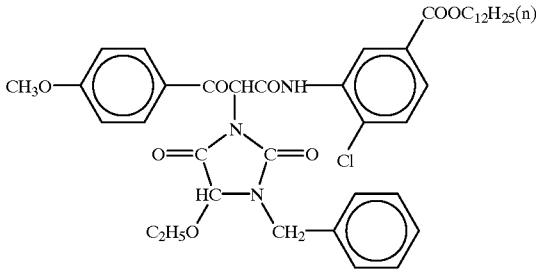
ExY-3
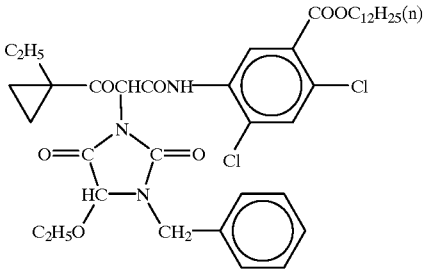
ExY-4
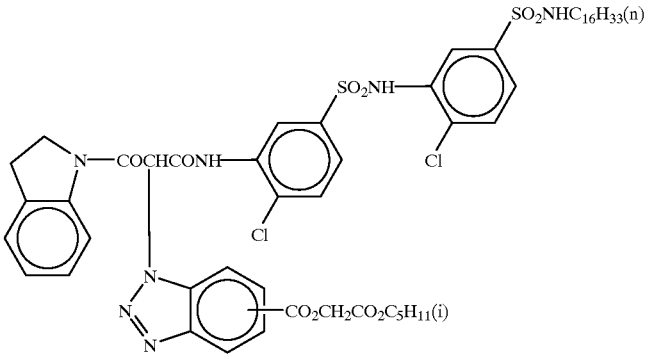
ExY-5
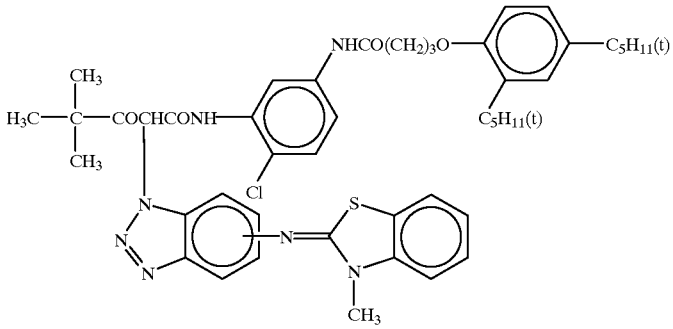
ExF-1
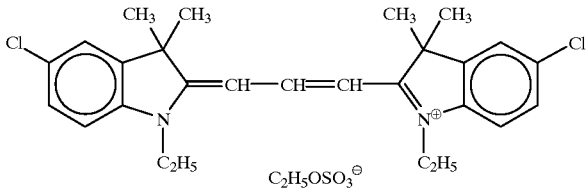

-continued
ExF-2
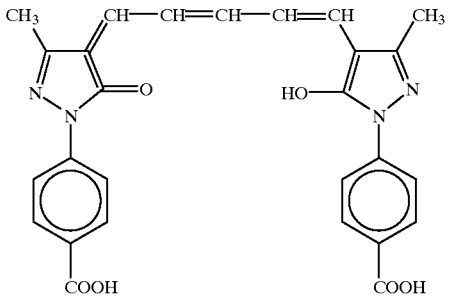
ExF-3
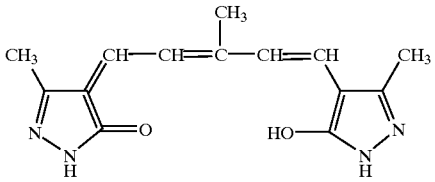
ExF-4
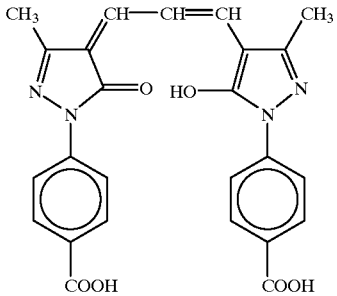
ExF-5
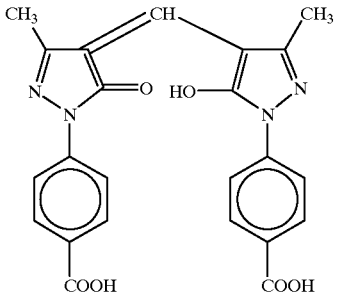
ExF-6
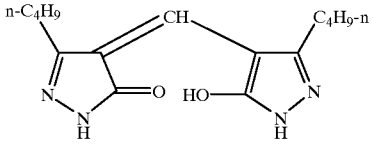
ExF-7
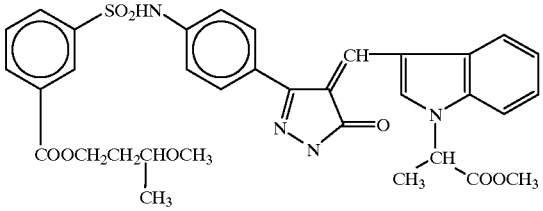
ExF-8
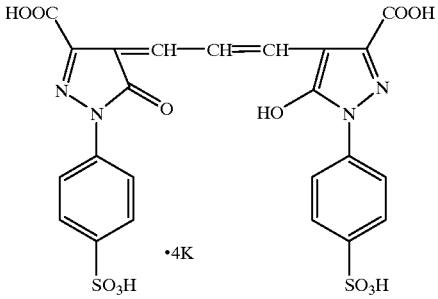
ExF-9
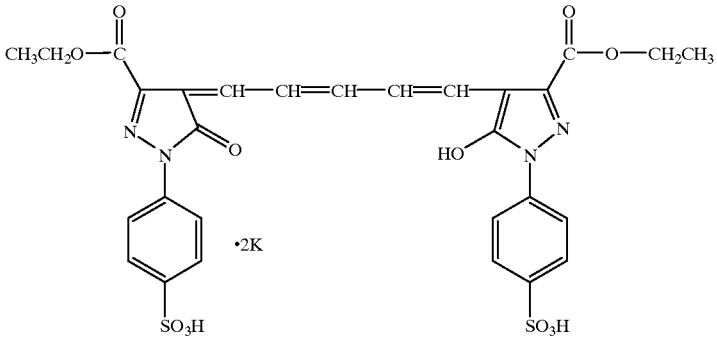

-continued
Cpd-1
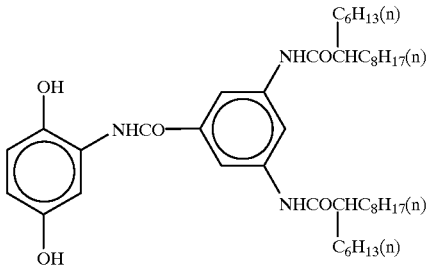
Cpd-2
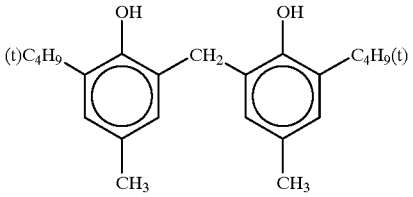
Cpd-3
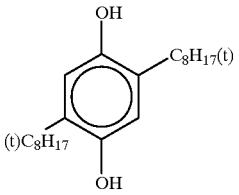
Cpd-4
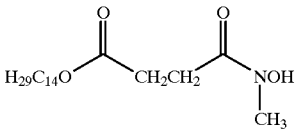
UV-1
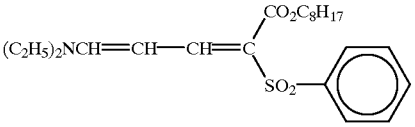
UV-2
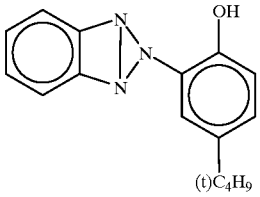
UV-3
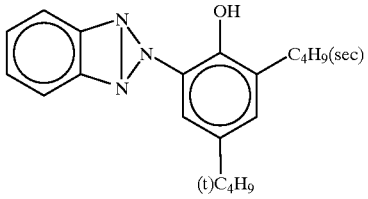
UV-4
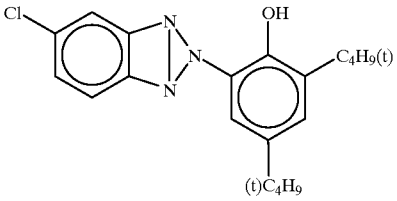
HBS-1
tricresylphosphate
HBS-2
di-n-butylphthalate
HBS-3
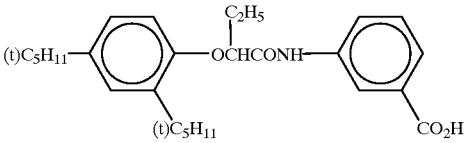
HBS-4
tri(2-ethylbexyl)phosphate
ExS-1
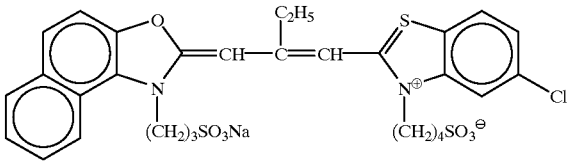
ExS-2
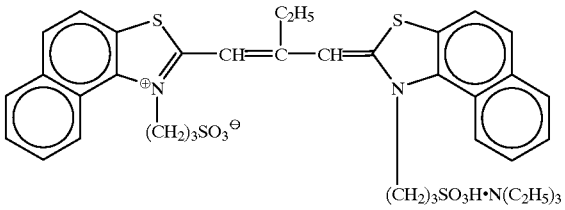

-continued
ExS-3
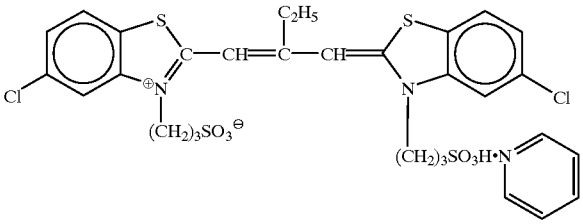
ExS-4
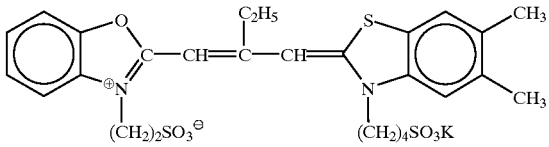
ExS-5
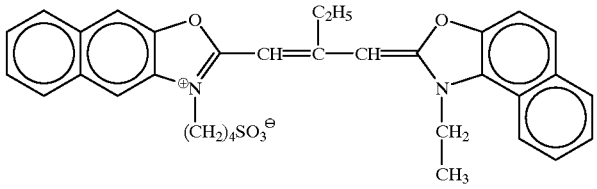
ExS-6
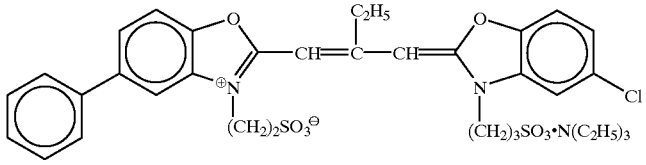
ExS-7
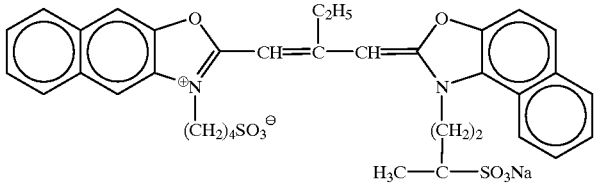
ExS-8
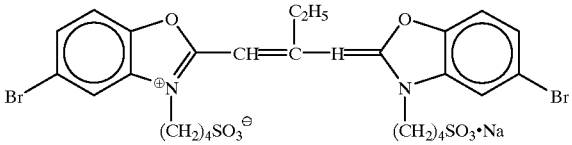
ExS-9
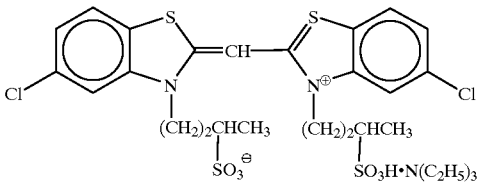
ES-1
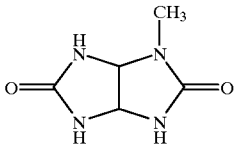
H-1
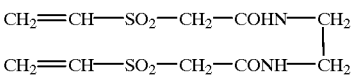
B-1
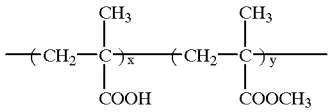
$x/y = 90$ -continued
B-2
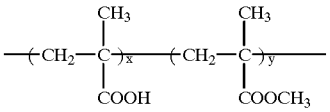
x/y = 40/60
B-3
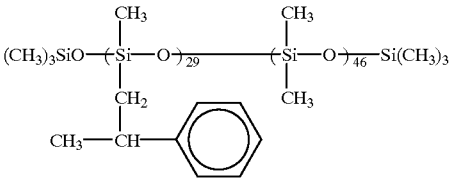
B-4
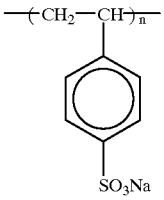
B-5
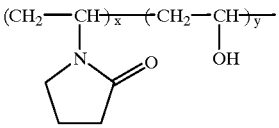
x/y = 70/30
B-6
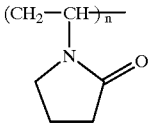
(mol. wt. about 10,000)
W-1
$C_8F_{17}SO_2NHCH_2CH_2CH_2OCH_2CH_2CH_2N^{\oplus}(CH_3)_3$
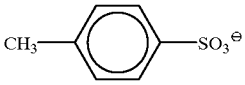
W-2
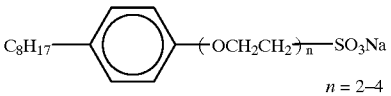
n = 2–4
W-3
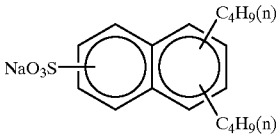
F-1
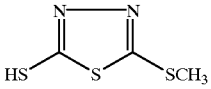
F-2
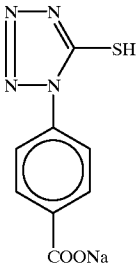
F-3
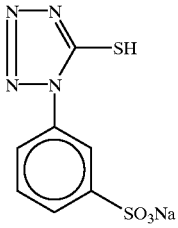
F-4
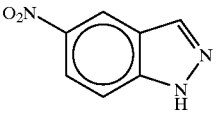
F-5
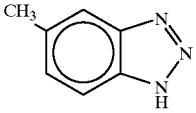
F-6
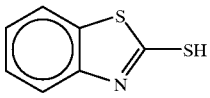

-continued

F-7

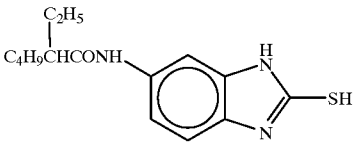

F-8

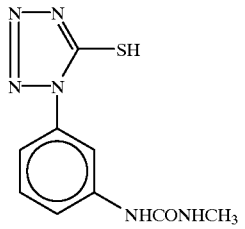

F-9

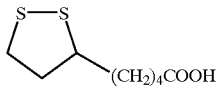

F-10

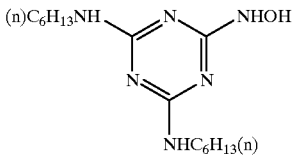

F-11

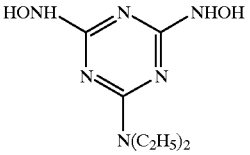

F-12

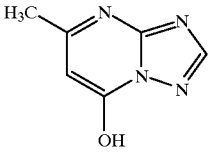

F-13

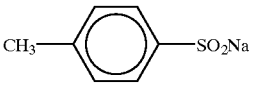

F-14

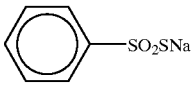

F-15

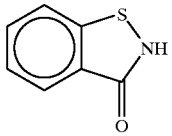

F-16

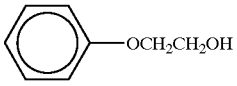

F-17

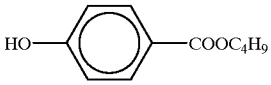

F-18

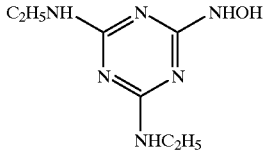

Samples 102 to 107 were formed by replacing the emulsion in the 13th layer of the sample 101 adjusted as described above with emulsions 1B to 1G.

These samples were given sensitometry exposure for 1/100 sec at a color temperature of 4800° K through a continuous wedge and subjected to the following color development.

The development herein used was done under the conditions described below at 38° C.

Processing Method.

| Step | Time | Temperature | Quantity of replenisher* | Tank volume |
|---|---|---|---|---|
| Color development | 3 min. 15 sec. | 38° C. | 33 ml | 20 l |
| Bleaching | 6 min. 30 sec. | 38° C. | 25 ml | 40 l |
| Washing | 2 min. 10 sec. | 24° C. | 1200 ml | 20 l |
| Fixing | 4 min. 20 sec. | 38° C. | 25 ml | 30 l |
| Washing (1) | 1 min. 05 sec. | 24° C. | Counter flow | 10 l |

-continued

Processing Method.

| Step | Time | Temperature | Quantity of replenisher* | Tank volume |
|---|---|---|---|---|
| | | | piping from (2) to (1) | |
| Washing (2) | 1 min. 00 sec. | 24° C. | 1200 ml | 10 l |
| Stabilization (3) | 1 min. 05 sec. | 38° C. | 25 ml | 10 l |
| Drying | 4 min. 20 sec. | 55° C. | | |

*A quantity of replenisher is represented by a value per meter of a 35-mm wide sample.

The compositions of the processing solutions will be described below.

| | Mother solution (g) | Replenishment solution (g) |
|---|---|---|
| (Color developing solution) | | |
| Diethylenetriamine-pentaacetic acid | 1.0 | 1.1 |
| 1-hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxylethylamino)-2-methylaniline sulfate | 4.5 | 5.5 |
| Water to make | 1.0 l | 1.0 l |
| pH | 10.05 | 10.10 |
| (Bleaching solution) | | |
| Ferric Sodium ethylenediamine-tetraacetate trihydrate | 100.0 | 120.0 |
| Disodium ethylene-diaminetetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| (Fixing solution) | | |
| Disodium ethylene-diaminetetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 l | 1.0 l |
| pH | 6.7 | 6.6 |
| (Stabilizing solution) | | |
| Formalin (37%) | 2.0 ml | 3.0 ml |
| Polyoxyethylene-p-monononylphenylether (average polymerization degree = 10) | 0.3 | 0.45 |
| Disodium ethylene-diaminetetraacetate | 0.05 | 0.08 |
| Water to make | 1.0 l | 1.0 l |
| pH | 5.0–8.0 | 5.0–8.0 |

The densities of the samples of the processing agents were measured in accordance with a conventional method.

The obtained sensitivity and fog were evaluated. The sensitivity was represented by the relative value of the reciprocal of an exposure amount required to make the optical density higher by 0.2 than fog.

Subsequently, the following processing was performed to evaluate the latent image storage stability and the aged fog. Each sample was wedge-exposed as described above, aged in an ambience at a temperature of 50° C. and a relative humidity of 60% for 14 days, and subjected to the color development as described above. The resultant data was compared with data obtained when the development was performed immediately after the exposure. The difference between the fog values was used as a representative value of the aged fog, and the difference between the sensitivities was used as a representative value of intensification and regression of latent image.

In addition, the following processing was performed to evaluate changes in the sensitivity and the fog caused by a pressure.

Each sample was placed in an ambience at a relative humidity of 55% for 3 hours and wedge-exposed in the same ambience. The resultant sample was applied with a load of 4 g by using a 0.1-mm ϕ needle, and the emulsion surface was scanned at a rate of 1 cm/sec. The densities of a portion applied with the pressure and a portion not applied with the pressure of the developed sample were measured by using a 5 μm×1 mm measurement slit. In this manner changes in the fog and the sensitivity when a pressure was applied were obtained.

TABLE 2 below shows the obtained results.

TABLE 2

| | Reduction sensitization before dislocation | Reduction sensitization after dislocation | Ambience after dislocation | Sensitivity | Fog |
|---|---|---|---|---|---|
| Emulsion 1A | Not performed | Not Performed | Unadjusted (pH 5) | 100 | 0.21 |
| Emulsion 1B | Performed | Performed | Unadjusted (pH 5) | 158 | 0.32 |
| Emulsion 1C | Performed | Not performed | Thiosulfonic acid was added | 172 | 0.26 |
| Emulsion 1D | Performed | Not performed | pH = 4 | 122 | 0.24 |
| Emulsion 1E | Not performed | Performed | Unadjusted (pH 5) | 175 | 0.29 |
| Emulsion 1F | Not performed | Performed | pH = 9 | 197 | 0.23 |
| Emulsion 1G | Not performed | Performed | Radical scavenger was added | 198 | 0.23 |

TABLE 2-continued

| | Fog after storage | Change in sensitivity after exposure and storage (%) | Fog when pressure was applied | Change in sensitivity when pressure was applied (%) | |
|---|---|---|---|---|---|
| Emulsion 1A | 0.25 | 97 | 0.24 | 100 | Comparative example |
| Emulsion 2B | 0.55 | 155 | 0.46 | 45 | Comparative example |
| Emulsion 1C | 0.43 | 143 | 0.45 | 41 | Comparative example |
| Emulsion 1D | 0.38 | 172 | 0.41 | 26 | Comparative example |
| Emulsion 1E | 0.47 | 129 | 0.39 | 78 | Present invention |
| Emulsion 1F | 0.27 | 101 | 0.26 | 96 | Present invention |
| Emulsion 1G | 0.25 | 98 | 0.27 | 100 | Present invention |

In comparison with the emulsion 1A, the emulsion 1B was reduction-sensitized in the whole region of grain formation. Both the storage stability and the resistance to damage by pressure were low, although the sensitivity was high.

In contrast, the emulsions 1C and 1D were reduction-sentisized by adding thiosulfonic acid or at a low pH only before dislocation lines were introduced. Consequently, it was found that although some properties were improved, there were properties, such as a change in the sensitivity when a pressure was applied, which were degraded compared to the emulsion 1B.

On the other hand, in the emulsions 1E to 1G of the present invention prepared by performing reduction sensitization after dislocation lines were introduced or performing reduction sensitization in a silver nucleus stabilizing ambience, both the storage stability and the resistance to damage by pressure were greatly improved while a high sensitivity of the reduction sensitization was maintained. That is, it was found that the emulsions 1E to 1G were improved to a level close to the level of the emulsion 1A not reduction-sensitized.

The foregoing indicates that the present invention can provide a high-speed silver halide emulsion having a high storage stability and a high resistance to damage by pressure and a color light-sensitive material using the emulsion.

Example 2

The influence that the silver ion solubility has when reduction sensitization is performed in the present invention will be described below.

Emulsions 2A to 2D were prepared by changing the solubility of silver ions by setting the pBr to 1.1 to 1.7 during the final growth in the preparation of the emulsion 1G in Example 1.

TABLE 3 below shows the results when a multilayer coated sample was formed and evaluated following the same procedures as in Example 1.

TABLE 3

| | pBr when reduction sensitization was performed | Silver ion solubility when reduction sensitization was performed (mol/l) | Sensitivity | Fog | Fog after storage | Change in sensitivity exposure and storage (%) | Fog when pressure was applied | Change in sensitivity when pressure was applied (%) |
|---|---|---|---|---|---|---|---|---|
| Emulsion 2A | 1.1 | $5 \times 10^{-6}$ | 76 | 0.39 | 0.55 | 135 | 0.47 | 77 |
| Emulsion 2B | 1.3 | $3 \times 10^{-6}$ | 88 | 0.35 | 0.51 | 126 | 0.43 | 78 |
| Emulsion 2C | 1.4 | $2 \times 10^{-6}$ | 98 | 0.33 | 0.44 | 121 | 0.38 | 87 |
| Emulsion 2D | 1.7 | $1 \times 10^{-6}$ | 100 | 0.23 | 0.25 | 98 | 0.27 | 100 |

TABLE 3 shows that the storage stability and the resistance to damage by pressure were improved while a high sensitivity was maintained by setting the silver ion solubility during reduction sensitization to be lower than $1.5\times10^{-6}$ mol/l.

Example 3

Emulsions 3A to 3F were prepared by adding radical scavenger A-35 (formula A-I), A-5, A-7 (formula A-II), A-21 (formula A-III), A-8 (formula A-IV), and A-2 (formula A-V), instead of the radical scavenger A-33, in the preparation of the emulsion 1G in Example 1. In addition, a comparative emulsion 3G was prepared following the same procedure as for the emulsion 1A in Example 1.

The emulsions 3A to 3G thus formed were added with sensitizing dyes and optimally chemically sensitized following the same procedures as in Example 1, thereby preparing emulsions 3A(B) to 3G(B).

Also, the emulsions 3A to 3G were added with $3\times10^{-4}$ mol/molAg of a sensitizing dye ExS-1, $1.5\times10^{-5}$ mol/molAg of a sensitizing dye ExS-2, and $4.5\times10^{-4}$ mol/molAg of a sensitizing dye ExS-3, and optimally subjected to gold—selenium—sulfur sensitization by using sodium thiosulfate, chloroauric acid, N,N-dimethylselenourea, and potassium thiocyanate, thereby forming emulsions 3A(R) to 3G(R).

Furthermore, emulsions 3A(G) to 3G(G) were formed following the same procedure as for the emulsion 3A(R) to 3G(R) except that the emulsions 3A to 3F were added with $5\times10^{-5}$ mol/molAg of a sensitizing dye ExS-4, $1.1\times10^{-4}$ mol/molAg of a sensitizing dye ExS-5, and $4.5\times10^{-4}$ mol/molAg of a sensitizing dye ExS-6.

Samples 301 to 307 were prepared by using the emulsions 3A(B) to 3G(B) in the 13th layer in Example 1, the emulsions 3A(R) to 3G(R) in the 9th layer in Example 1, and the emulsions 3A(G) to 3G(G) in the 10th layer in Example 1, and evaluated following the same procedures as in Example 1. Note that the evaluations were done by packing the samples in cartridges, actually performing photography, and printing on color paper, instead of sensitometry.

The samples 301 to 306 of the present invention had a sensitivity higher by a half aperture value than the sensitivity of the comparative sample 307. All samples had good properties after being stored in a high-temperature environment after the photography. Also, when a pressure was applied, no pressure marks were found in any sample, indicating that all samples had a practically high enough resistance to damage by pressure.

As described above, the samples 301 to 306 of the present invention were color photographic materials having an extremely high sensitivity without degrading the storage stability and the resistance to damage by pressure.

EFFECT OF THE INVENTION

By the present invention, it is possible to obtain a high-quality, high-speed silver halide photographic light-sensitive material with a high storage stability and a high resistance to damage by pressure.

What is claimed is:

1. A silver halide emulsion comprising silver halide tabular grains whose average aspect ratio is 2 to 40 and silver halide tabular grains having dislocation lines in a peripheral portion of a grain account for 100 to 60% of a projected area of all silver halide grains in the silver halide emulsion and which grain formation is performed in a silver nucleus stabilizing ambience from the beginning of the grain formation or the midst of the grain formation to the end of the grain formation, and which reduction sensitization is performed in the silver nucleus stabilizing ambience after the formation of the dislocation lines is started.

2. The silver halide emulsion according to claim 1, wherein the silver nucleus stabilizing ambience is achieved by adding a radical scavenger.

3. The silver halide emulsion according to claim 1, wherein the silver nucleus stabilizing ambience is achieved by setting a pH between 7 and 10.

4. A silver halide photographic light-sensitive material comprising a red light-sensitive emulsion layer, a green light-sensitive emulsion layer, and a blue light-sensitive emulsion layer on a support, wherein each of said light-sensitive layers has at least two emulsion layers different in sensitivity, and at least one highest-speed layer of said light-sensitive layers contains a silver halide emulsion according to claim 1.

5. A silver halide photographic light-sensitive material comprising a red light-sensitive emulsion layer, a green light-sensitive emulsion layer, and a blue light-sensitive emulsion layer on a support, wherein each of said light-sensitive layers has at least two emulsion layers different in sensitivity, and at least one highest-speed layer of said light-sensitive layers contains a silver halide emulsion according to claim 2.

6. A silver halide photographic light-sensitive material comprising a red light-sensitive emulsion layer, a green light-sensitive emulsion layer, and a blue light-sensitive emulsion layer on a support, wherein each of said light-sensitive layers has at least two emulsion layers different in sensitivity, and at least one highest-speed layer of said light-sensitive layers contains a silver halide emulsion according to claim 3.

7. A silver halide photographic light-sensitive material comprising a red light-sensitive emulsion layer, a green light-sensitive emulsion layer, and a blue light-sensitive emulsion layer on a support, wherein each of said light-sensitive layers has at least two emulsion layers different in sensitivity, and the highest-speed blue-sensitive emulsion layer of said light-sensitive layers contains a silver halide emulsion according to claim 2.

8. A silver halide photographic light-sensitive material comprising a red light-sensitive emulsion layer, a green light-sensitive emulsion layer, and a blue light-sensitive emulsion layer on a support, wherein each of said light-sensitive layers has at least two emulsion layers different in sensitivity, and the highest-speed blue-sensitive emulsion layer of said light-sensitive layers contains a silver halide emulsion according to claim 3.

* * * * *